US012722923B2

(12) United States Patent
Someya et al.

(10) Patent No.: US 12,722,923 B2
(45) Date of Patent: Sep. 1, 2026

(54) PLOTTER PINCH ROLLER MECHANISM

(71) Applicant: SILHOUETTE JAPAN CORPORATION, Yokohama (JP)

(72) Inventors: Hironari Someya, Yokohama (JP); Yoshitaka Tsunoi, Yokohama (JP)

(73) Assignee: SILHOUETTE JAPAN CORPORATION, Yokohama (JP)

( * ) Notice: Subject to any disclaimer, the term of this patent is extended or adjusted under 35 U.S.C. 154(b) by 0 days.

(21) Appl. No.: 18/801,146

(22) Filed: Aug. 12, 2024

(65) Prior Publication Data

US 2025/0058991 A1 Feb. 20, 2025

(30) Foreign Application Priority Data

Aug. 14, 2023 (JP) ..... 2023-131965

(51) Int. Cl.
*B65H 5/06* (2006.01)

(52) U.S. Cl.
CPC ..... *B65H 5/062* (2013.01); *B65H 2402/32* (2013.01); *B65H 2404/1521* (2013.01); *B65H 2404/1523* (2013.01); *B65H 2407/20* (2013.01)

(58) Field of Classification Search
CPC .... B65H 5/062; B65H 2407/20; B41J 13/025; B41J 13/076
See application file for complete search history.

(56) References Cited

U.S. PATENT DOCUMENTS

| | | | | |
|---|---|---|---|---|
| 6,523,933 | B1 * | 2/2003 | Hirano | B41J 13/103 347/36 |
| 8,075,213 | B2 * | 12/2011 | Takada | B41J 15/04 400/636 |
| 8,870,364 | B2 * | 10/2014 | Miyashita | B65H 5/062 347/5 |
| 11,772,393 | B2 * | 10/2023 | Nonaka | B41J 11/0045 347/104 |
| 11,964,842 | B2 * | 4/2024 | Tsunoi | B65H 5/062 |
| 2019/0111712 | A1 * | 4/2019 | Nonaka | B41J 29/02 |
| 2022/0242150 | A1 | 8/2022 | Nonaka | |

FOREIGN PATENT DOCUMENTS

| | | | |
|---|---|---|---|
| JP | 06-199094 A | | 7/1994 |
| JP | H06199094 | * | 7/1994 |
| JP | 2017-186109 A | | 10/2017 |
| JP | 2021-195181 A | | 12/2021 |

OTHER PUBLICATIONS

Extended European Search Report and Search Opinion received for European Application No. 24194269.7, mailed on Jan. 21, 2025, 8 pages.

* cited by examiner

*Primary Examiner* — Patrick Cicchino
(74) *Attorney, Agent, or Firm* — WOMBLE BOND DICKINSON (US) LLP

(57) ABSTRACT

The pinch roller mechanism comprises: a slider which is supported by a rail movably in a left-right direction; a roller support member which moves in an up-down direction while being supported by the slider, and a pinch roller which is rotatably supported by the roller support member. The slider includes a window that exposes the pinch roller diagonally upward on the upstream side in the conveyance direction.

7 Claims, 24 Drawing Sheets

PLOTTER PINCH ROLLER MECHANISM

TECHNICAL FIELD

The present invention relates to a plotter pinch roller mechanism that biases the pinch roller toward the medium.

BACKGROUND ART

A cutting plotter is provided with a plurality of pinch rollers for pressing a to-be-cut medium against the roller for driving the medium, as disclosed, for example, in JP 6046998 B (Document 1). The position of the pinch roller needs to be changed according to the size of the to-be-cut medium. For this reason, the pinch roller is configured to be able to move in a first direction (hereafter, this direction is referred to as the "left-right direction") which intersects the conveyance direction (hereafter, the conveyance direction is referred to as the "front-rear direction") of the to-be-cut medium and which is parallel to the horizontal direction. When moving the pinch roller, it is necessary to keep the pinch roller spaced apart from the medium driving roller. Document 1 discloses a pinch roller mechanism capable of manually switching between a configuration in which the pinch roller is pressed onto the medium driving roller and a configuration in which the pinch roller is spaced apart from the medium driving roller.

In Document 1, the pinch roller is supported by a rail member extending in the left-right direction via a pinch roller mechanism. The pinch roller mechanism includes a support member which is disposed below the rail member and which is supported by the rail member, and an arm member which extends in the front-rear direction and which is supported by a lower end of the support member swingably in the up-down direction. The arm member is supported by the support member in an intermediate portion in the front-rear direction. A pinch roller is provided at the front end of the arm member on the front of the apparatus, and a drive mechanism is connected to the rear end of the arm member. The rear end of the arm member is biased upward by the spring member. The drive mechanism is configured to push the rear end of the arm member downward by a cam member operated by a lever. The pressing of the pinch roller is released by pressing the rear end of the arm member downwards.

The pinch roller mechanism disclosed in Document 1 is large because the rail member and the pinch roller mechanism are aligned in the up-down direction. Moreover, since it is configured to drive arm members using cam members, the number of components is large and costs a lot. Therefore, it is difficult to use the pinch roller mechanism disclosed in Document 1 for a cutting plotter for consumer use. Examples of pinch roller mechanisms used in cutting plotters for consumer use include those disclosed in, for example, JP 2017-186109 A (Document 2).

The pinch roller mechanism disclosed in Document 2 includes an axial member extending from the left end to the right end of the cutting plotter, and a cylindrical pinch roller member through which the axial member passes. The pinch roller member includes a pinch roller on the same axis. In this pinch roller mechanism, a pressing force for pressing the pinch roller onto the medium driving roller is transmitted to the pinch roller via the axial member.

By having the configuration disclosed in Document 2, it is possible to reduce the number of components compared to having the configuration disclosed in Document 1. However, it is difficult to use the pinch roller mechanism disclosed in Document 2 for large-sized cutting plotters. This is because the pressing force that presses the pinch roller onto the medium driving roller is weakened due to the center portion of the axial member being deflected. As disclosed in JP 2021-195181 A (Document 3), such an issue can be solved to a certain extent by using a rail having high rigidity and constituted by a drawn material instead of an axial member that causes deflection.

The pinch roller mechanism disclosed in Document 3 includes a sliding member that is supported by a rail having high rigidity and constituted by a drawn material movably in the left-right direction. A roller support member including a pinch roller is supported by the sliding member movably in the up-down direction. The pinch roller is rotatably supported by the roller support member. The roller support member is biased downward by a spring member provided between the sliding member and the roller support member. The rail is formed to have a strip shape wide in the front-rear direction to increase rigidity, and covers the sliding member and the roller support member from above.

However, there is a problem in the pinch roller mechanism disclosed in Document 3 that the position of the pinch roller cannot be determined such that the desired position of the to-be-cut medium is pressed by the pinch roller because the pinch roller is hidden under the rail.

SUMMARY OF THE INVENTION

The present invention aims to provide a plotter pinch roller mechanism that increases visibility of the pinch roller even when using a rail with high rigidity.

A plotter pinch roller mechanism according to an aspect of the present invention comprises: a rail extending above a work stage, to which a sheet-shaped medium is conveyed, in a first direction which intersects with a conveyance direction of the medium and which is parallel to a horizontal direction; a slider supported by the rail and movable in the first direction while the rail is passing through the slider; a roller support member configured to move in an up-down direction while being supported by the slider; a pinch roller which is supported by the roller support member rotatably about an axis in the first direction; a spring which is arranged between the slider and the roller support member and which is configured to bias the roller support member downward; and a pressing release mechanism which includes an operating lever swingably supported by the slider and which is configured to push the roller support member upwards against a spring force of the spring by an operating force applied to the operating lever, wherein the slider includes a window that exposes the pinch roller diagonally upward on the upstream side in the conveyance direction.

BRIEF DESCRIPTION OF THE DRAWINGS

FIG. 15A shows a perspective view of the operating lever from diagonally front upward, FIG. 15B shows a perspective view of the operating lever from diagonally rear downward, and FIG. 15C shows an enlarged perspective view of the front end of the lever portion.

DETAILED DESCRIPTION OF THE INVENTION

First Embodiment

Figure 1:
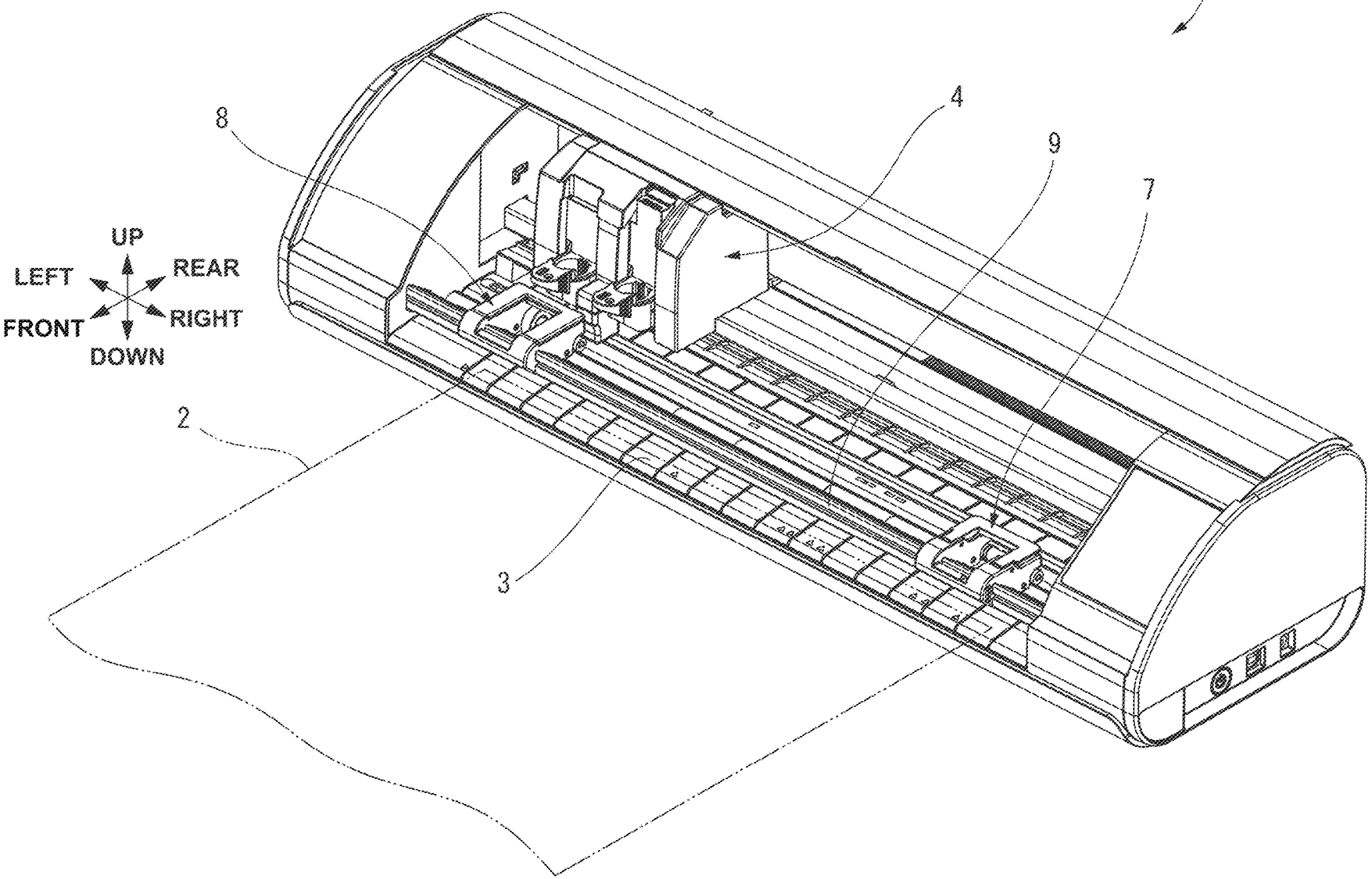
FIG. 1 shows a perspective view of a cutting plotter including a pinch roller mechanism according to a first embodiment.

Hereinafter, a first embodiment of the plotter pinch roller mechanism according to the present invention will be described in detail with reference to FIGS. 1-17. The cutting plotter 1 shown in FIG. 1 is for cutting out figures and characters from a sheet-shaped to-be-cut medium 2 (hereinafter simply referred to as the "medium 2"). The cutting plotter 1 includes a work stage 3 on which the medium 2 is conveyed and a pen carriage 4 for supporting cutting pens not illustrated. The medium 2 may be a single sheet, a rolled sheet, etc.

Work Stage and Pen Carriage

The work stage 3 is formed so as to extend in a conveyance direction (a direction from lower left to upper right in FIG. 1) of the medium 2 and a left-right direction (a direction from upper left to lower right in FIG. 1) which intersects the conveyance direction and which is parallel to the horizontal direction. In the following, downstream of the medium 2 in the conveyance direction is referred to as the "rear side", and upstream of the medium 2 in the conveyance direction is referred to as the "front side".

Figure 2:
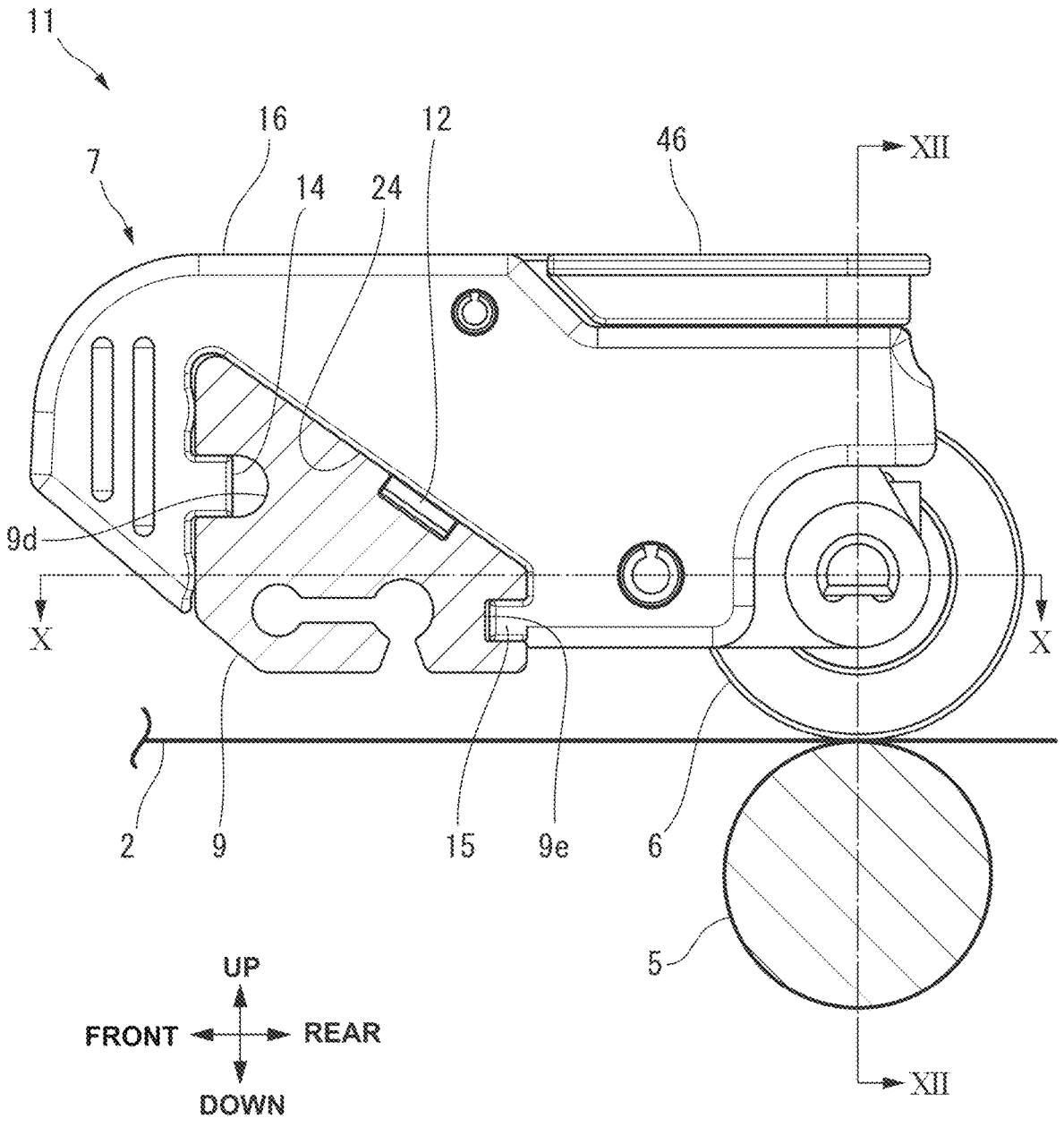
FIG. 2 shows a side view of a pinch roller unit.

A medium driving roller 5 is arranged on the lower portion of the work stage 3. On the work stage 3, there is an opening (not illustrated) in which the upper surface of the medium driving roller 5 is exposed. The medium 2 is conveyed by rotating the medium driving roller 5 with the medium 2 being sandwiched between the medium driving roller 5 and the pinch roller 6, as shown in FIG. 2.

The pen carriage 4 has a function of driving the cutting pen (not illustrated) in the up-down direction, and is configured to be movable in the left-right direction. The "up-down direction" herein is a vertical direction intersecting the work stage 3. The medium 2 is cut by attaching a cutting pen to the pen carriage 4, rotating the medium driving roller 5 in a forward or reverse direction with the medium 2 being sandwiched between the medium driving roller 5 and the pinch roller 6, and piercing the cutting pen into the medium 2 and moving the cutting pen along with the pen carriage 4 in the left-right direction.

Summary of the Pinch Roller

The pinch rollers 6 are respectively provided in the pinch roller units 7 and 8, which are illustrated in two left and right parts in the vicinity of the work stage 3 in FIG. 1. In the following, for convenience, the pinch roller unit located on the right side of FIG. 1 is referred to as the "first pinch roller unit 7", and the pinch roller unit located on the left side is referred to as the "second pinch roller unit 8". The first and second pinch roller units 7, 8 are supported by a rail 9 located in the upper vicinity of the work stage 3.

The rail 9 constitutes a pinch roller mechanism 11 (see FIG. 2) together with the first and second pinch roller units 7, 8. The rail 9 extends in the left-right direction so as to extend from the left end to the right end of the work stage 3 in the upper vicinity of the work stage 3. Both ends of the rail 9 are fixed to the frame (not illustrated) of the cutting plotter 1.

Rail

Figure 4:
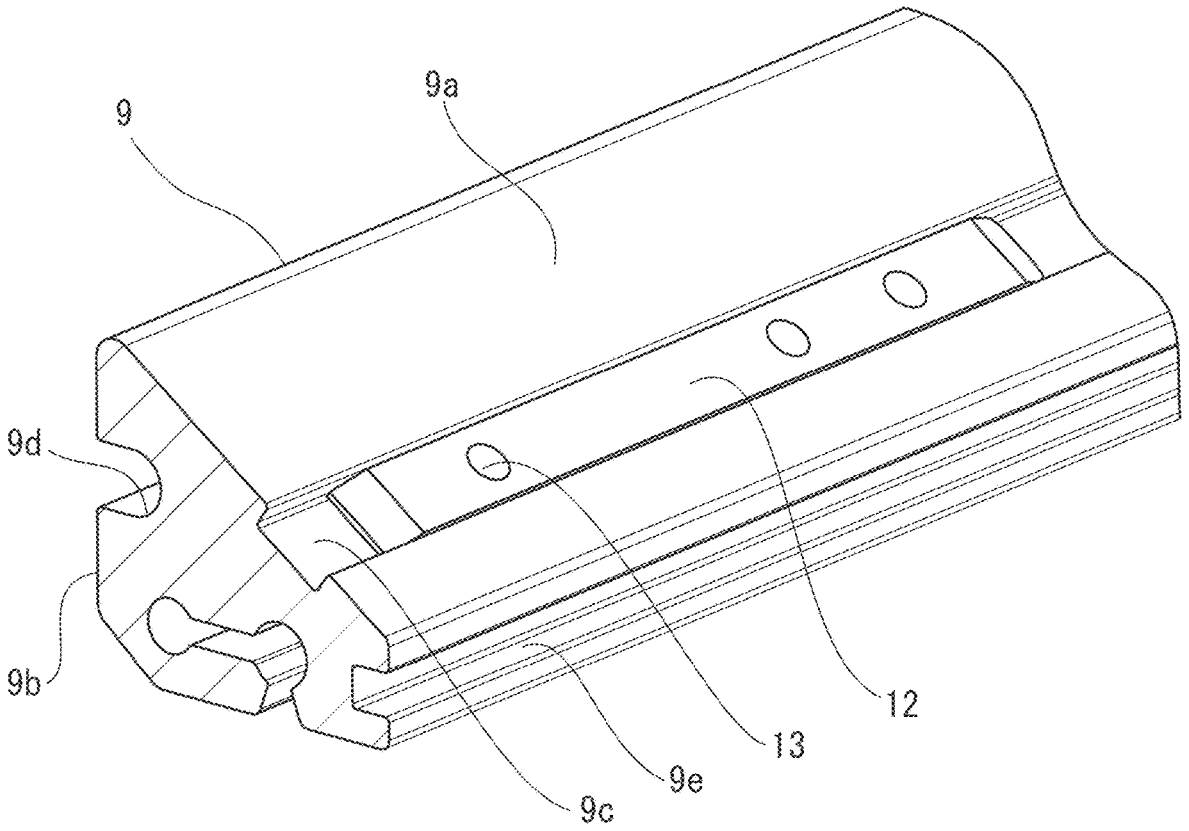
FIG. 4 shows a perspective cross-sectional view of the rail.

The rail 9 is formed by a drawn material having a predetermined cross-section. The rail 9 according to this embodiment is formed such that the cross-section is a substantially right triangle as shown in FIG. 4. The rail 9 is used in a posture in which the inclined surface 9*a* faces upper rearwards and the front surface 9*b* extends in the up-down direction. A first groove 9*c* extending in the left-right direction is formed on the inclined surface 9*a* of the rail 9, and a second groove 9*d* extending in the left-right direction is formed on the front surface 9*b*. Moreover, a third groove 9*e* extending in the left-right direction is formed on the rear end of the rail 9.

A plate-shaped member 12 used to position the first pinch roller unit 7, which will be described later, in the left-right direction is attached to the first groove 9*c*. Recesses 13 are formed on the upper surface of the plate-shaped member 12. The recesses 13 are respectively formed on a plurality of positions arranged at predetermined intervals in the left-right direction. As will be described in detail later, the first pinch roller unit 7 is configured so that a part of the first pinch roller unit 7 fits into the recess 13 and the pinch roller 6 is positioned in an optimal position on the medium 2 when a standard-based medium 2 is used.

The second groove 9*d* and the third groove 9*e* engage with first and second engagement members 14 and 15 provided on the first pinch roller unit 7, which will be described later, as shown in FIG. 2. The first and second engagement members 14 and 15 engage with the second and third grooves 9*d* and 9*e*, thereby preventing the first pinch roller unit 7 from disengaging upwardly with respect to the rail 9. Although not illustrated in detail, the second pinch roller unit 8 is also prevented from disengaging by engaging with the rail 9 similarly to the first pinch roller unit 7.

Pinch Roller Unit

Figure 5:
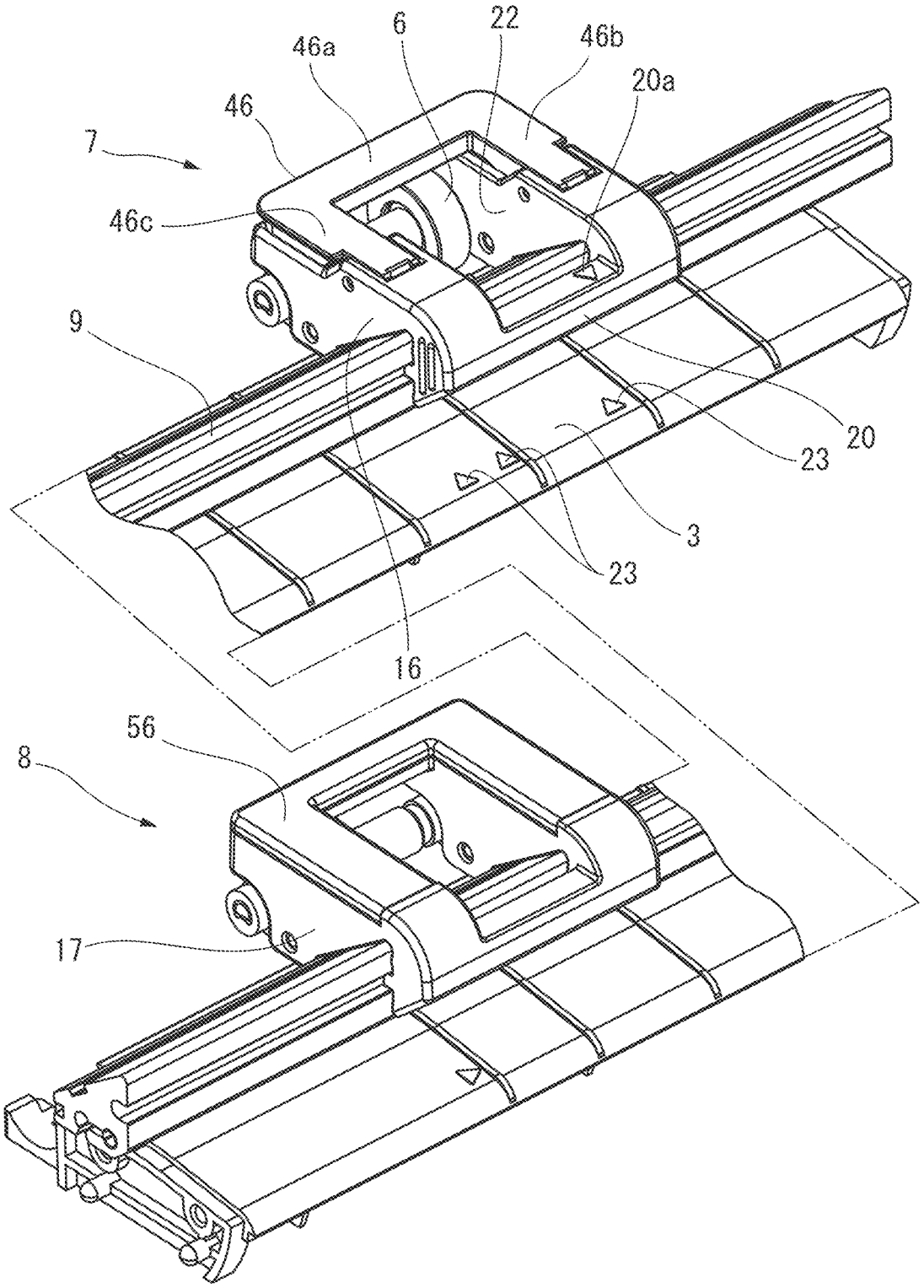
FIG. 5 shows a perspective view of the pinch roller unit.

The first and second pinch roller units 7 and 8 are configured by assembling various functional components onto the sliding members (sliders) 16 and 17 through which the rail 9 passes in the left-right direction, as shown in FIG. 5. The second pinch roller unit 8 is different from the first pinch roller unit 7 only in some components. For this reason, the first pinch roller unit 7 will be described in detail here but the second pinch roller unit 8 will only be described as necessary.

Figure 3:
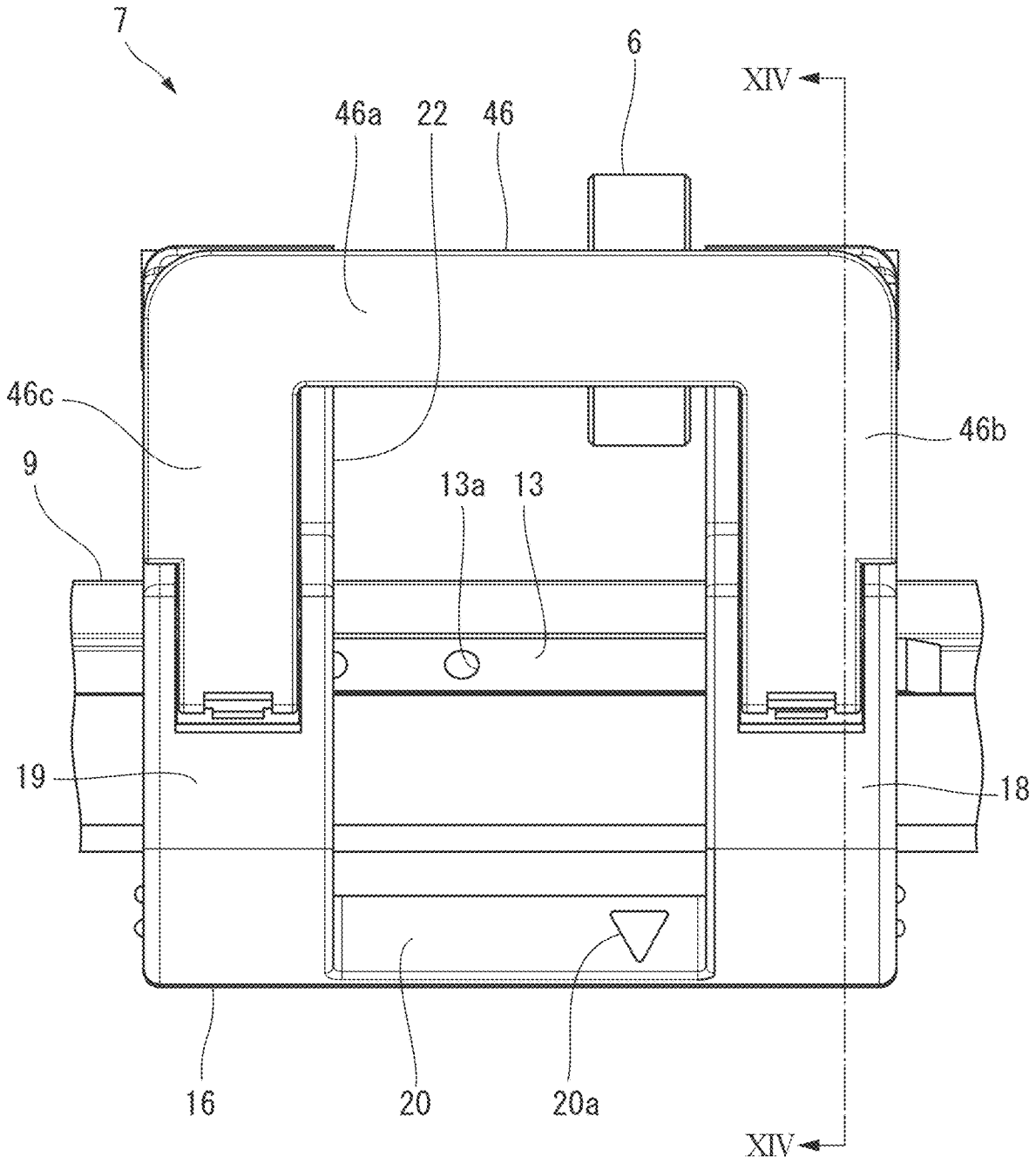
FIG. 3 shows a plan view of the pinch roller unit.
Figure 6:
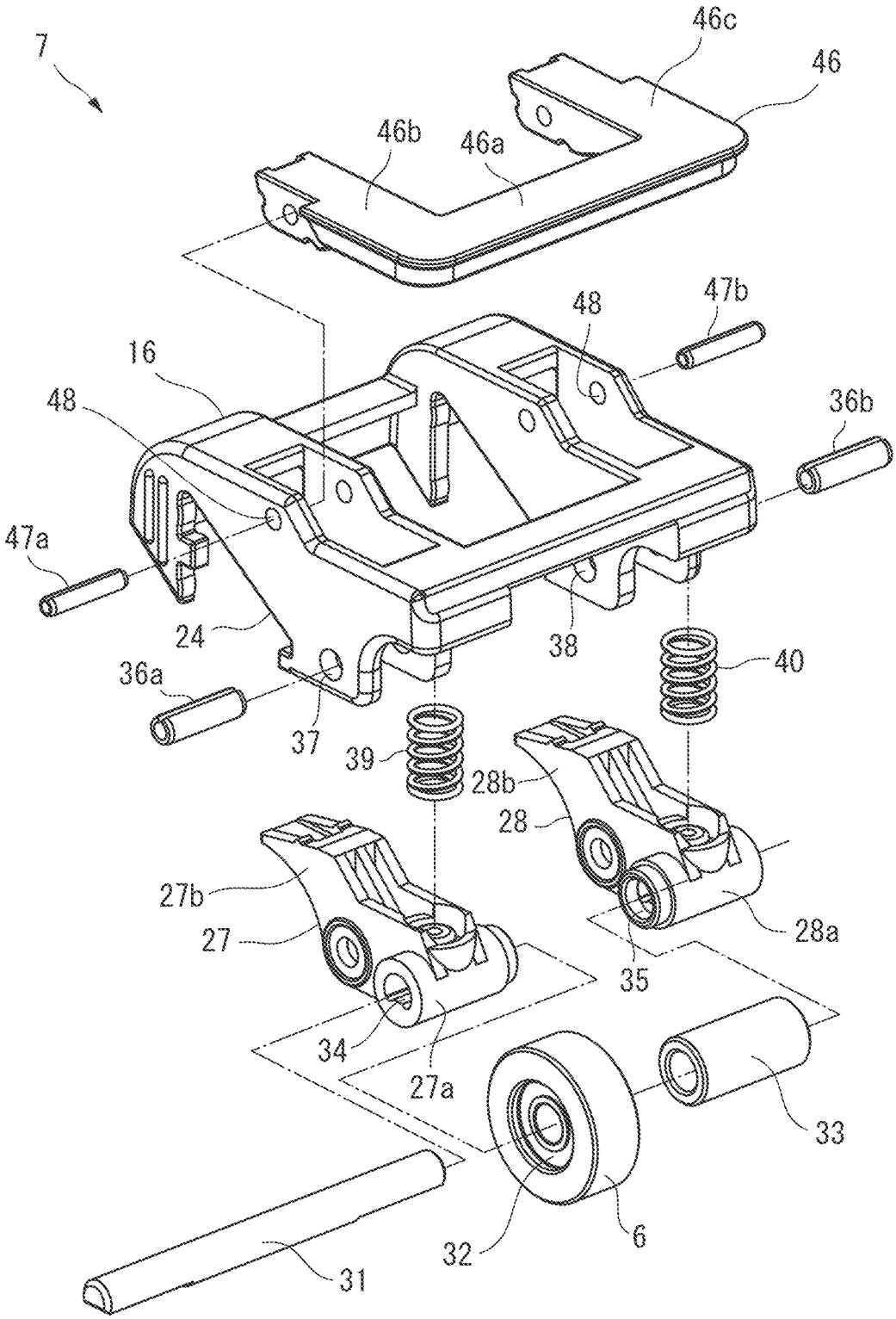
FIG. 6 shows an exploded perspective view from diagonally upward of the pinch roller unit.
Figure 7:
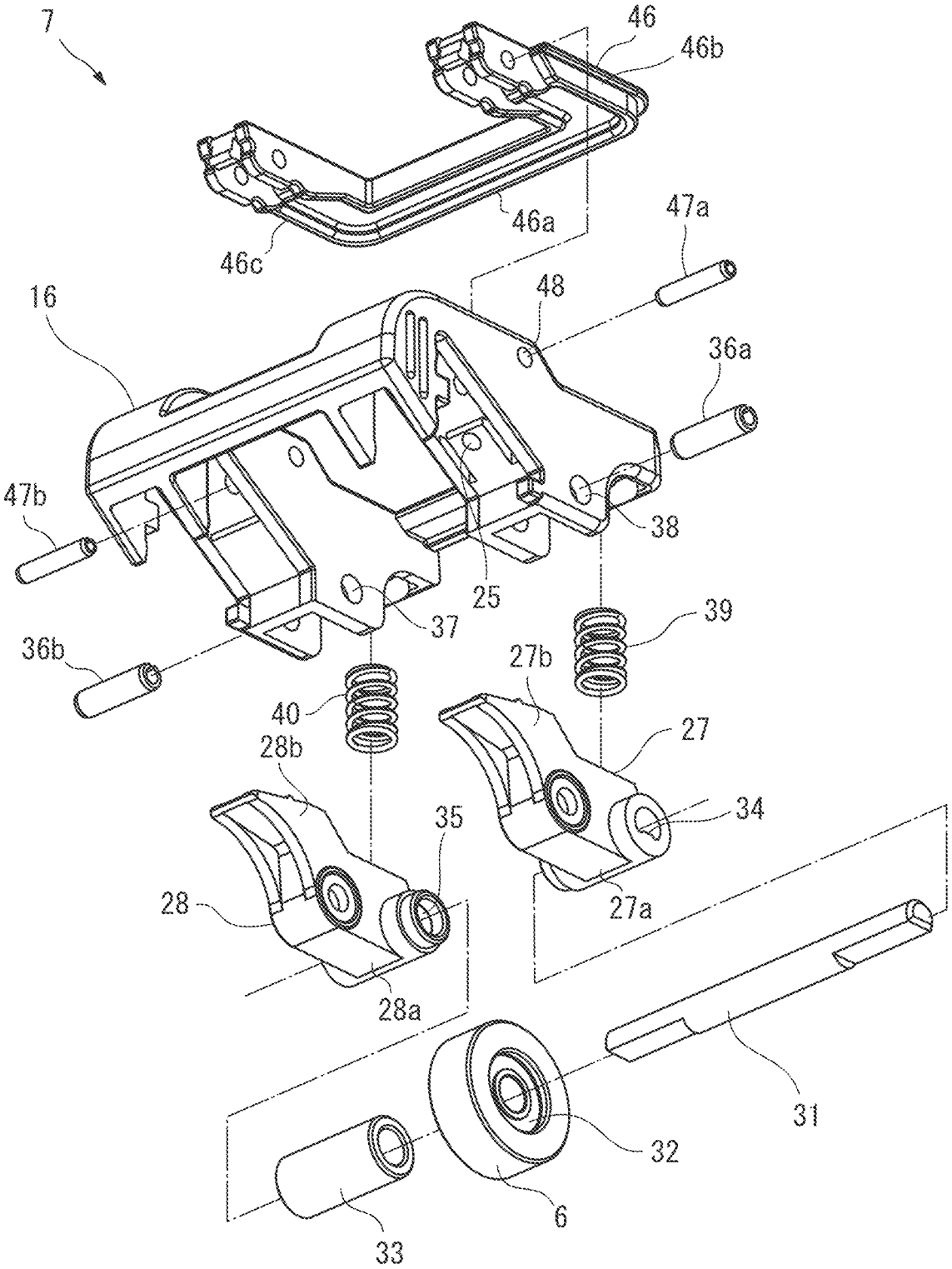
FIG. 7 shows an exploded perspective view from diagonally downward of the pinch roller unit.
Figure 8:
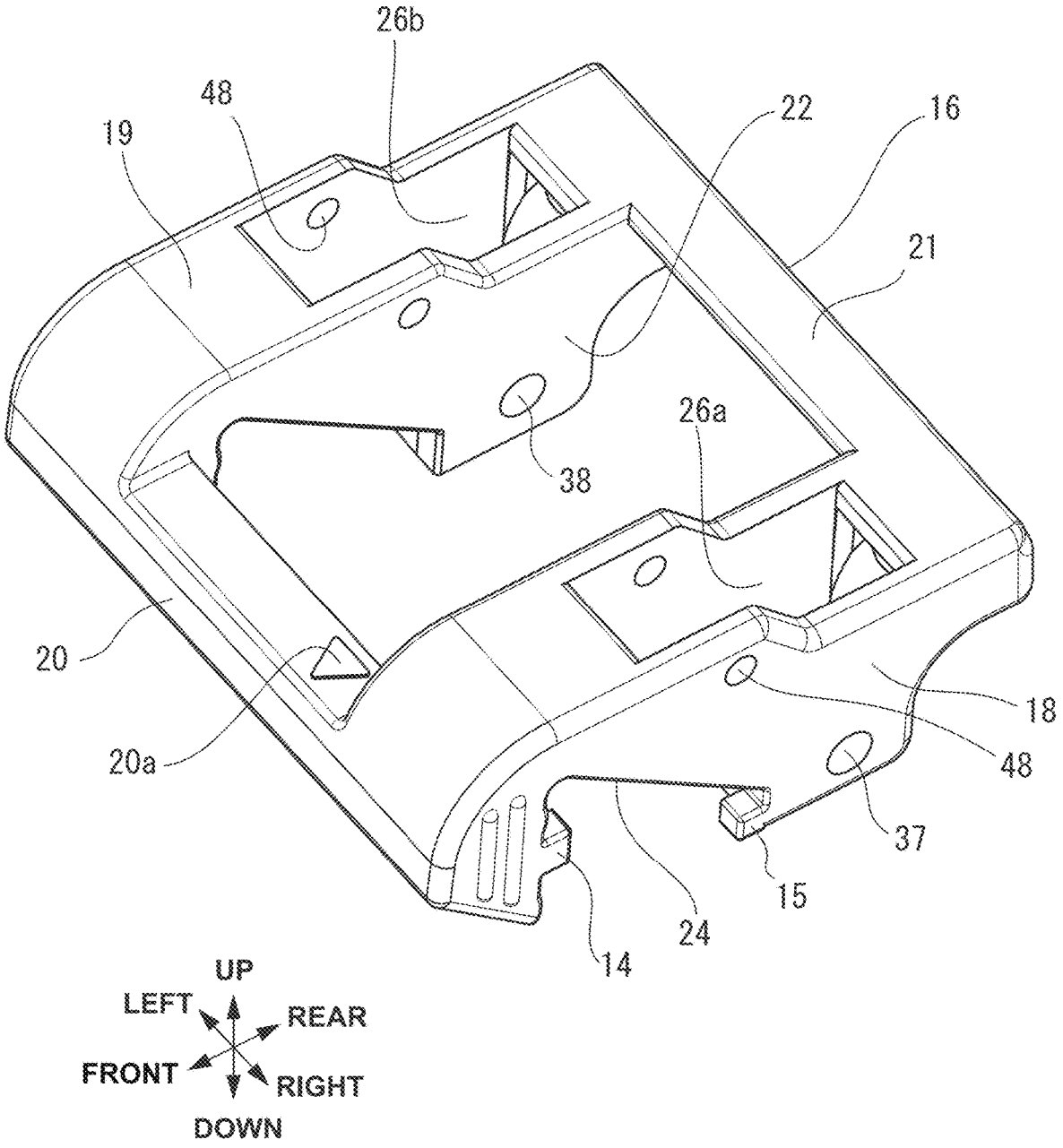
FIG. 8 shows a perspective view from diagonally upward of the sliding member.

The sliding member 16 of the first pinch roller unit 7 is formed in a quadrilateral frame form when viewed from above as shown in FIGS. 6 and 8. Specifically, the sliding member 16 includes: a right arm 18 and a left arm 19 extending in the front-rear direction while being spaced apart from each other in the left-right direction; a front connecting portion 20 connecting the front ends of the right arm 18 and the left arm 19 with each other; and a rear connecting portion 21 connecting the rear ends of the right arm 18 and the left arm 19 with each other. A window portion (window) 22 constituted by a quadrilateral through hole is formed on the center part of the sliding member 16. A movable side marker 20*a* for identifying the movable side is formed on the upper surface of the front connecting portion 20. The movable side marker 20*a* is formed in the vicinity of the opening of the window portion 22 and in the same position as the pinch roller 6 in the left-right direction, as shown in FIG. 3.

Meanwhile, as shown in FIG. 5, a fixed side marker 23 for identifying the fixed side is formed on the front end of the work stage 3. The fixed side marker 23 serves as a guide for the position of the pinch roller 6 when a standard-based medium 2 is used. By aligning the fixed side marker 23 with the movable-side marker 20*a* formed on the sliding member 16 in the front-rear direction, the pinch roller 6 is positioned in an optimal position for the respective medium 2 when a standard-based medium 2 is used.

As shown in FIG. 8, depressed portions 24 for passing the rail 9 are formed on lower portions of the front side of the sliding member 16. The above-described first and second engagement members 14 and 15 are formed on the depressed portions 24, and the depressed portions 24 are formed so that the rail 9 is movably fitted into the depressed portions 24. Therefore, with the rail 9 fitted into the depressed portions 24, the sliding member 16 is supported by the rail 9 movably in the left-right direction with the rail 9 passing through the sliding member 16 in the left-right direction. The first engagement member 14 protrudes toward rearward on the front end of the depressed portion 24. The second engagement member 15 protrudes toward forward on the rear end of the depressed portion 24.

Figure 9:
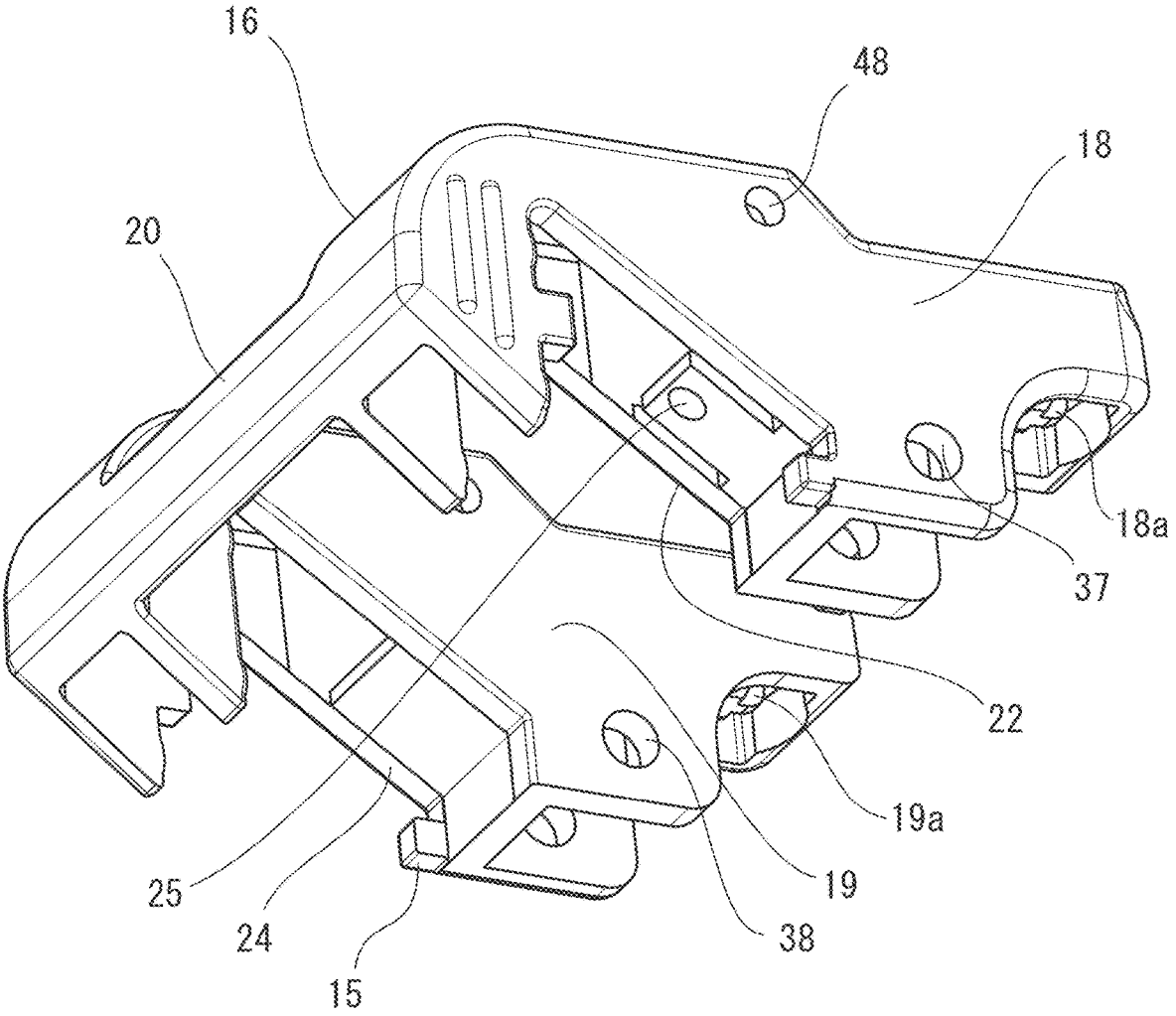
FIG. 9 shows a perspective view from diagonally downward of the sliding member.

As shown in FIG. 9, in the sliding member 16 used in the first pinch roller unit 7, a protrusion 25 is formed on the depressed portion 24 on a portion that faces the inclined surface 9*a* of the rail 9. The protrusion 25 is formed so as to fit onto the recess 13 formed on the plate-shaped member 12 provided on the rail 9. By fitting the protrusion 25 into the recess 13 formed on the plate-shaped member 12, resistance increases when the first pinch roller unit 7 moves along the rail 9, and thus the operator can feel a sense of moderation.

Cavities 26*a* and 26*b* opening to the up-down direction are respectively formed on the right arm 18 and the left arm 19 as shown in FIG. 8. Portions of a left and right pair of roller support members 27 and 28 (see FIGS. 6 and 7) for supporting the pinch roller 6 are inserted from the bottom into the cavities 26*a* and 26*b*.

Figure 10:
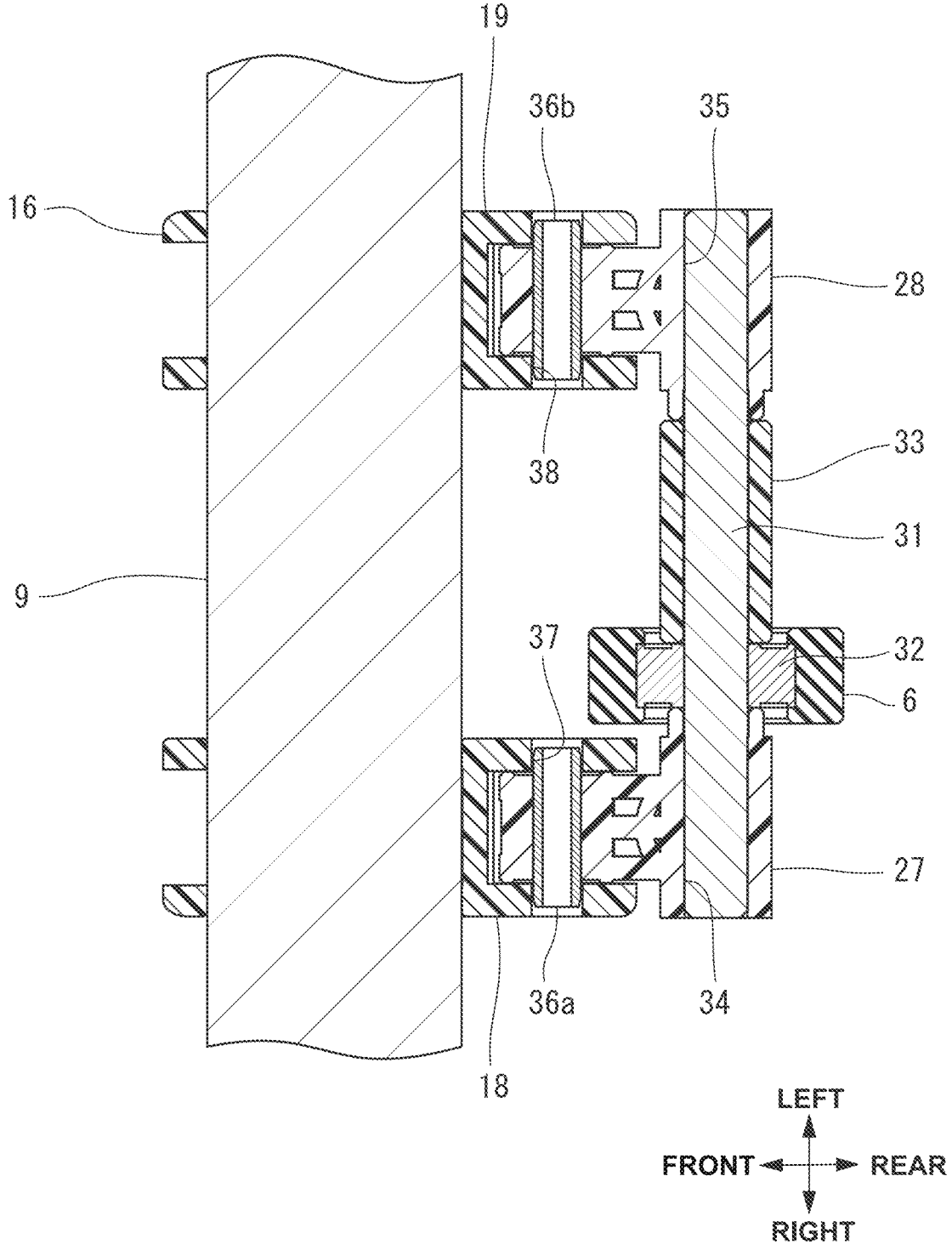
FIG. 10 shows a cross-sectional view along line X-X in FIG. 2.

The pinch roller 6 is rotatably supported by a shaft 31 extending in the left-right direction via a bearing member 32 as shown in FIG. 10. The two ends of the shaft 31 are respectively fixed to the roller support members 27 and 28. The shaft 31 according to this embodiment is fixed to the roller support members 27 and 28 with the shaft 31 passing through a tubular spacer 33. The spacer 33 is for defining the position of the pinch roller 6 in the left-right direction, and is interposed between the pinch roller 6 and the left roller support member 28.

The right roller support member 27 and the left roller support member 28 are formed symmetrical in the left-right direction, and are formed to extend in the front-rear direction (the conveyance direction of the medium). The right roller support member 27 and the left roller support member 28 have rear ends (first ends) 27*a* and 28*a* and front ends (second ends) 27*b* and 28*b*, the rear ends and the front ends respectively being opposite ends to each other in the front-rear direction.

Through holes 34 and 35 extending in the left-right direction are formed on the rear ends 27*a* and 28*a* of the right roller support member 27 and the left roller support member 28. The two ends of the shaft 31 supporting the pinch roller 6 fit in the through holes 34 and 35 to be fixed therein. The cross section of the fitted portion between the shaft 31 and the right roller support member 27/the left roller support member 28 is formed in a D shape so that the shaft 31 does not rotate. As the shaft 31 is mounted on the right roller support member 27 and the left roller support member 28, the pinch roller 6 is supported by the rear ends 27*a* and 28*a* of the right roller support member 27 and the left roller support member 28.

The right roller support member 27 and the left roller support member 28 are supported by the sliding member 16 on the intermediate part in the conveyance direction movably in the up-down direction. Specifically, the right roller support member 27 is formed such that it can be inserted onto the cavity 26*a* in the right arm 18 from below. The left roller support member 28 is formed such that it can be inserted onto the cavity 26*b* in the left arm 19 from below. Lower support pins 36*a* and 36*b* (see FIG. 10) each extending in the left-right direction are fixed onto intermediate parts of the right roller support member 27 and the left roller support member 28 in the front-rear direction, the intermediate parts being inserted into the cavities 26*a* and 26*b*. The lower support pin 36*a* attached to the right roller support member 27 is pivotably fit into the through hole 37 formed on the lower end of the right arm 18. The lower support pin 36*b* of the left roller support member 28 is pivotably fit into the through hole 38 formed on the lower end of the left arm 19.

In this way, the right roller support member 27 and the left roller support member 28 are respectively supported by the sliding member 16 via the lower support pins 36*a* and 36*b*. Thereby, the pinch roller 6 is supported by the sliding member 16 via the right roller support member 27 and the left roller support member 28 movably in the up-down direction when the pinch roller 6 is supported by the right roller support member 27 and the left roller support member 28 rotatably about axes thereof in the left-right direction.

Figure 11:
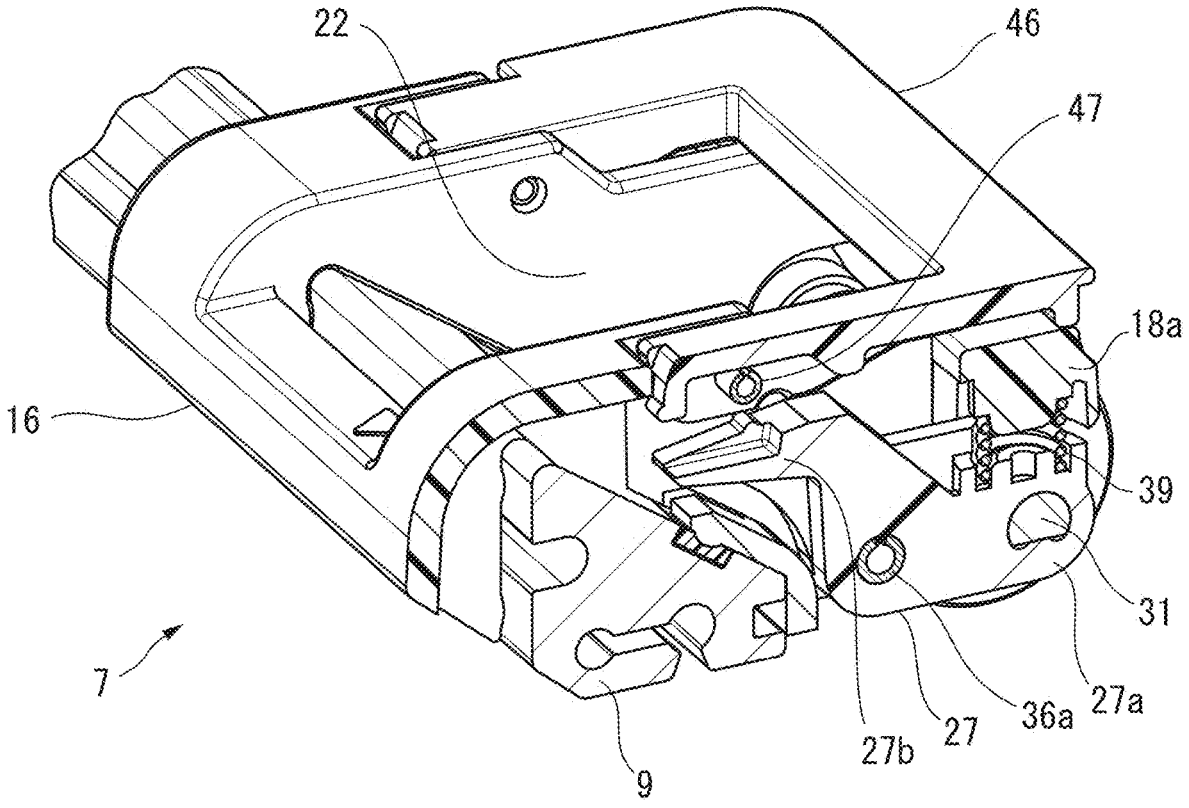
FIG. 11 shows a perspective cross-sectional cutaway view illustrating a substantial part of the pinch roller unit broken.
Figure 12:
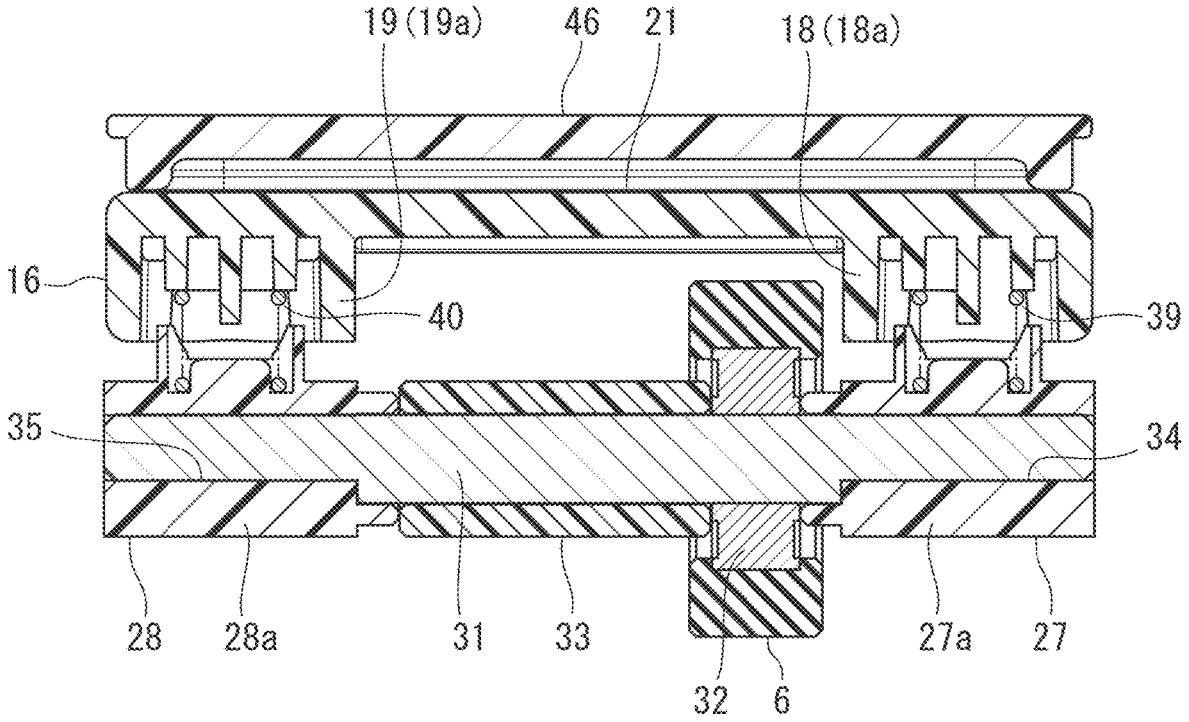
FIG. 12 shows a cross-sectional view along line XII-XII in FIG. 2.

As shown in FIGS. 11 and 12, a right spring member (spring) 39 constituted by a compression coil spring is inserted between the rear end 27*a* of the right roller support member 27 and the rear end 18*a* of the right arm 18 in a compressed state. Moreover, a left spring member (spring) 40 constituted by a compression coil spring is inserted between the rear end 28*a* of the left roller support member 28 and the rear end 19*a* of the left arm 19 in a compressed state. Therefore, the rear end 27*a* of the right roller support member 27 and the rear end 28*a* of the left roller support member 28 are biased downward with respect to the sliding member 16 by the right spring member 39 and the left spring member 40.

Moreover, when the pinch roller 6 is supported by the sliding member 16 via the right roller support member 27 and the left roller support member 28, the pinch roller 6 is disposed below the rear connecting portion 21 of the sliding member 16 as shown in FIG. 12. The pinch roller 6 in this position can be seen through the window portion 22 from diagonally above on the upstream side in the conveyance direction, as shown in FIG. 5.

Figure 13:
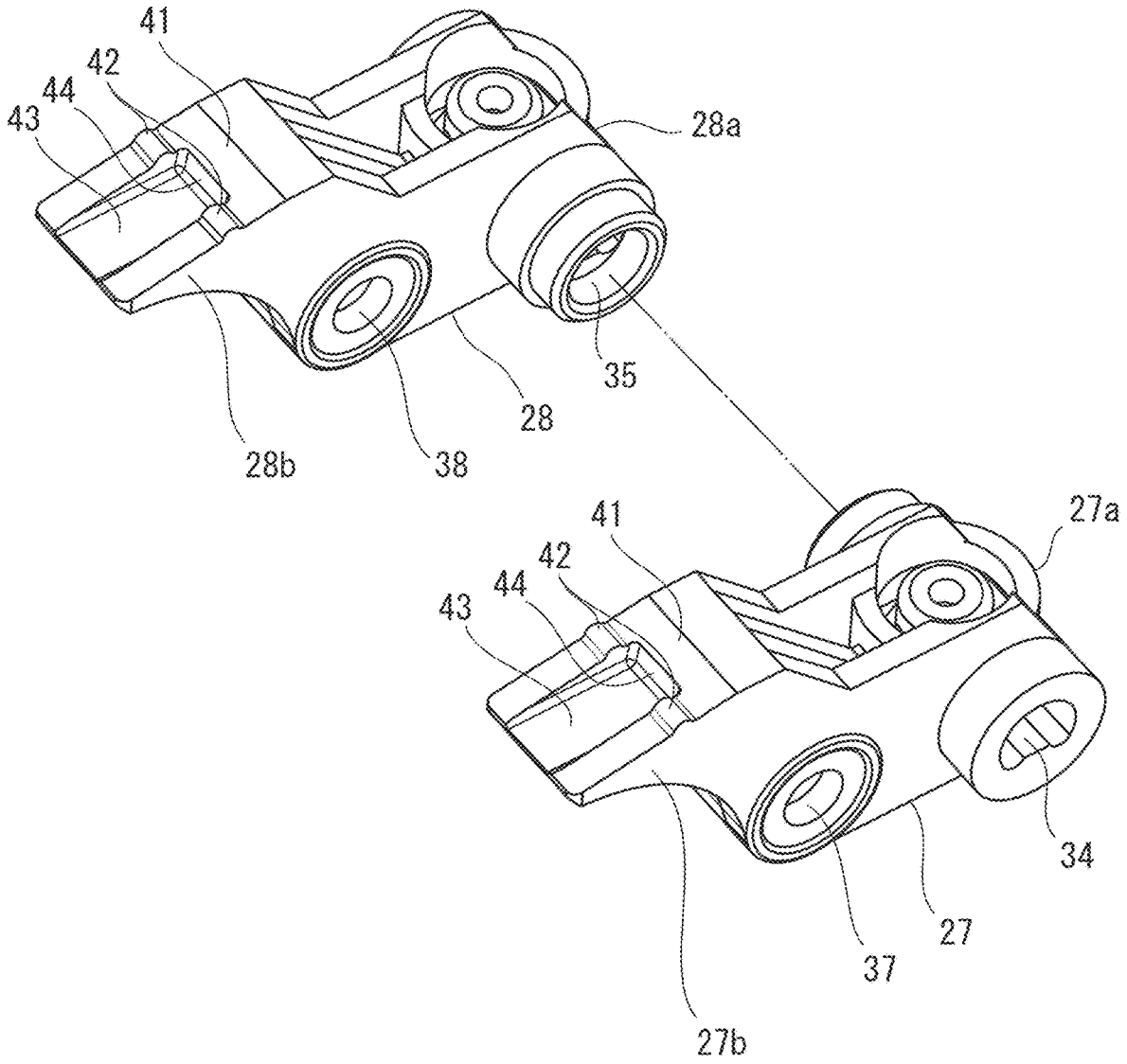
FIG. 13 shows a perspective view of a right roller support member and a left roller support member.

The front portion of the right roller support member 27 and the front portion of the left roller support member 28 are formed to extend upwardly and forwardly from the lower support pins 36*a* and 36*b* as shown in FIG. 11. As shown in FIG. 13, substantially flat pressure receiving surfaces 41 extending in the front-rear direction and protrusions 42 protruding upward from the pressure receiving surfaces 41 are formed on an upper end of the front portion of the right roller support member 27 and an upper end of the front portion of the left roller support member 28. Recesses 43 are respectively formed on the pressure receiving surfaces 41. The recesses 43 are formed on the front end of the right roller support member 27 and the front end of the left roller support member 28 so as to be open upwards and forwards, and are defined in part by vertical walls 44 extending in the left-right direction and the up-down direction and facing forwards. Stopper pieces 55 on the operating lever 46 described later are inserted into the recesses 43.

The pressure receiving surfaces 41 and the protrusions 42 of the right roller support member 27 and the left roller support member 28 in the first pinch roller unit 7 form a part of the pressing release mechanism 45 (see FIG. 14) described later. The pressing release mechanism 45 is for releasing the pressing of the pinch roller 6 onto the medium driving roller 5.

Figure 15A:
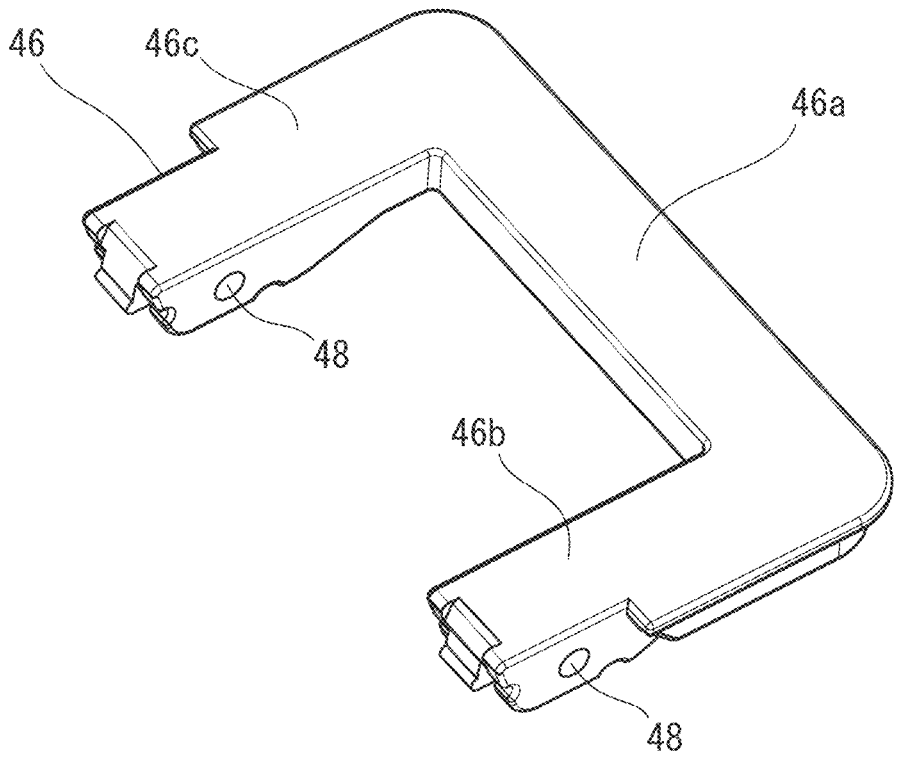
FIGS. 15A-15C show perspective views of the operating lever. Specifically.
Figure 15B:
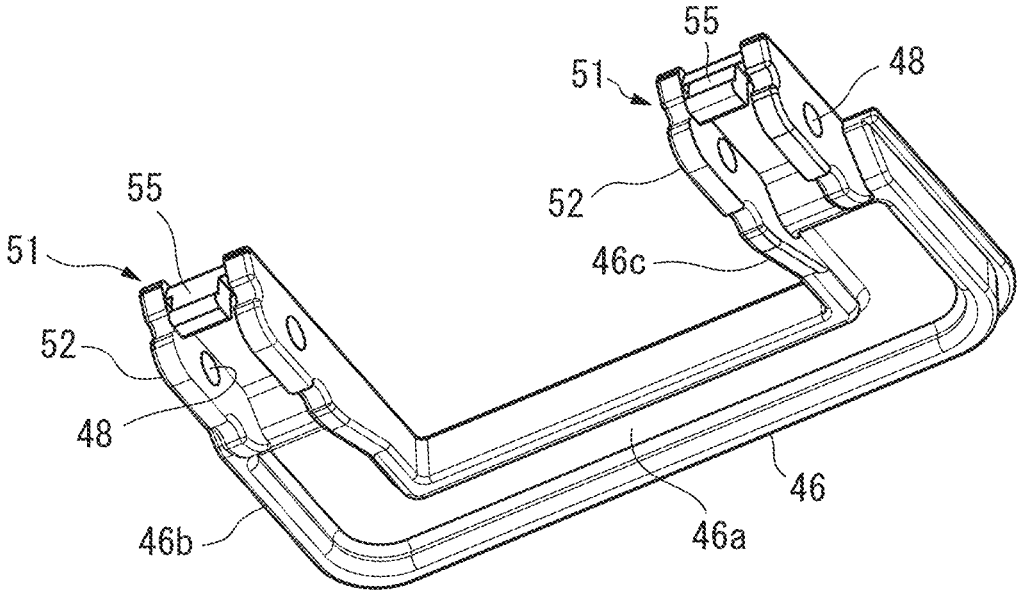
Figure 15C:
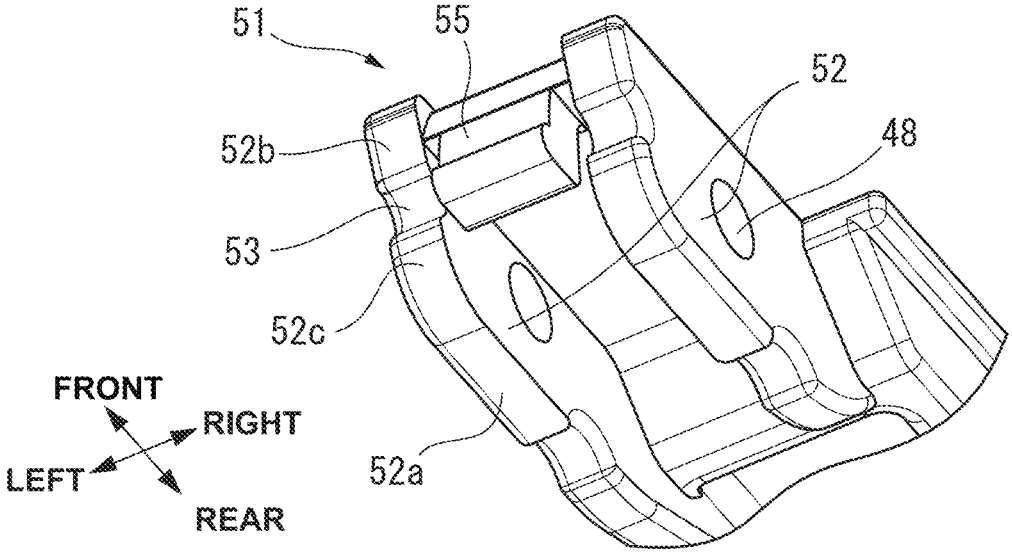

The pressing release mechanism 45 is constituted by the pressure receiving surfaces 41 and the protrusions 42 described above, and an operating lever 46 provided on the sliding member 16 of the first pinch roller unit 7. The operating lever 46 is formed in a U shape as shown in FIGS. 15A-15C. The operating lever 46 includes a gripping portion 46*a* extending in the left-right direction, and a pair of lever portions 46*b* and 46*c* extending from the two ends of the gripping portion 46*a* in a second direction substantially orthogonal to the left-right direction. The first end of the lever portion 46*b* is connected to the first end of the gripping portion 46*a*, and the first end of the lever portion 46*c* is connected to the second end of the gripping portion 46*a*.

The lever portions 46*b* and 46*c* are disposed on the two left and right sides of the window portion 22 of the sliding member 16 as shown in FIG. 5. Pivoted ends (second ends) of the lever portions 46*b* and 46*c* are positioned above the front ends 27*b* and 28*b* of the right roller support member 27 and the left roller support member 28, and are supported by the right arm 18 and the left arm 19 of the sliding member 16 swingably by the upper support pins 47*a* and 47*b*, respectively.

Figure 14:
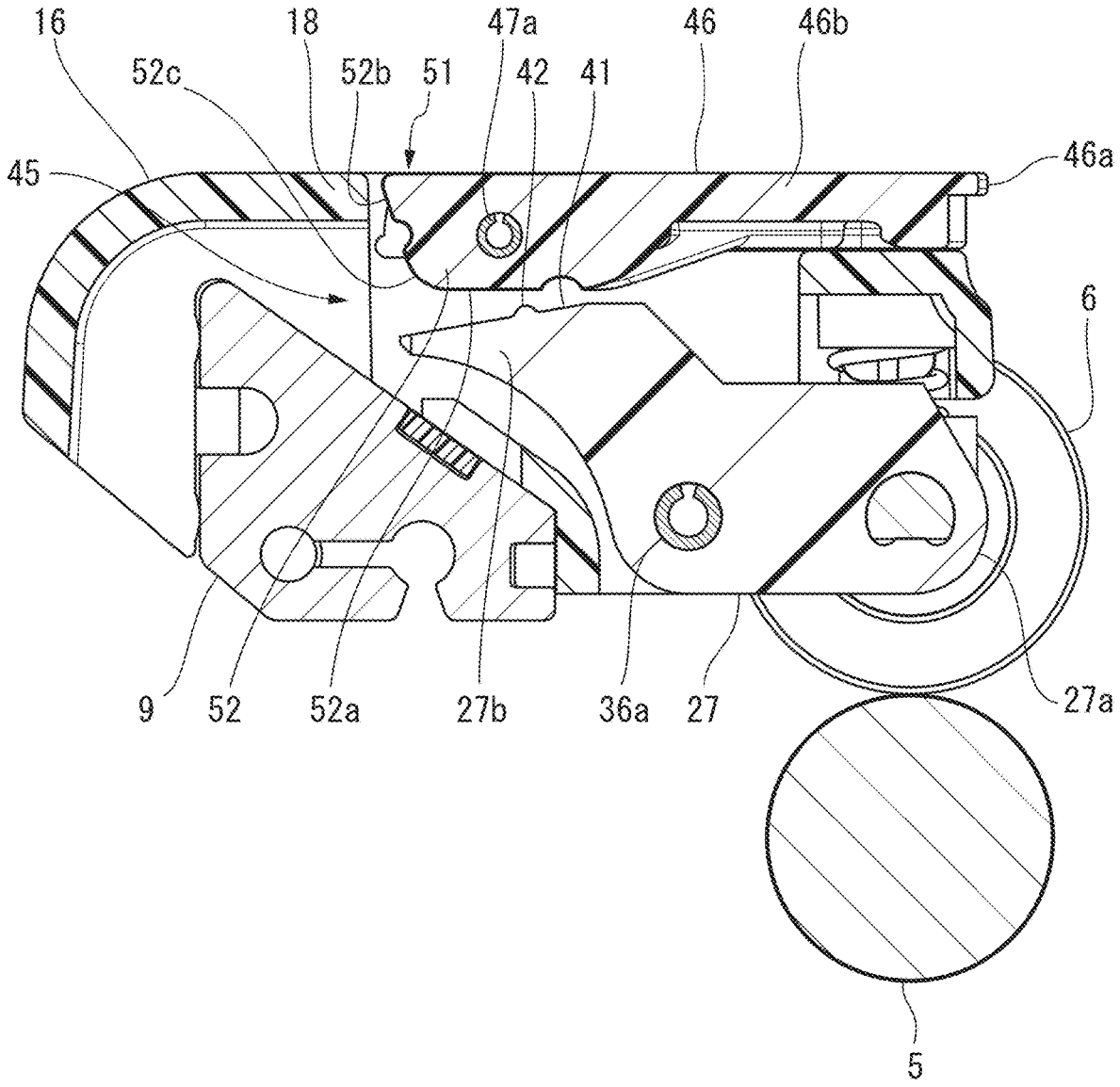
FIG. 14 shows a cross-sectional view along line XIV-XIV in FIG. 3.
Figure 16:
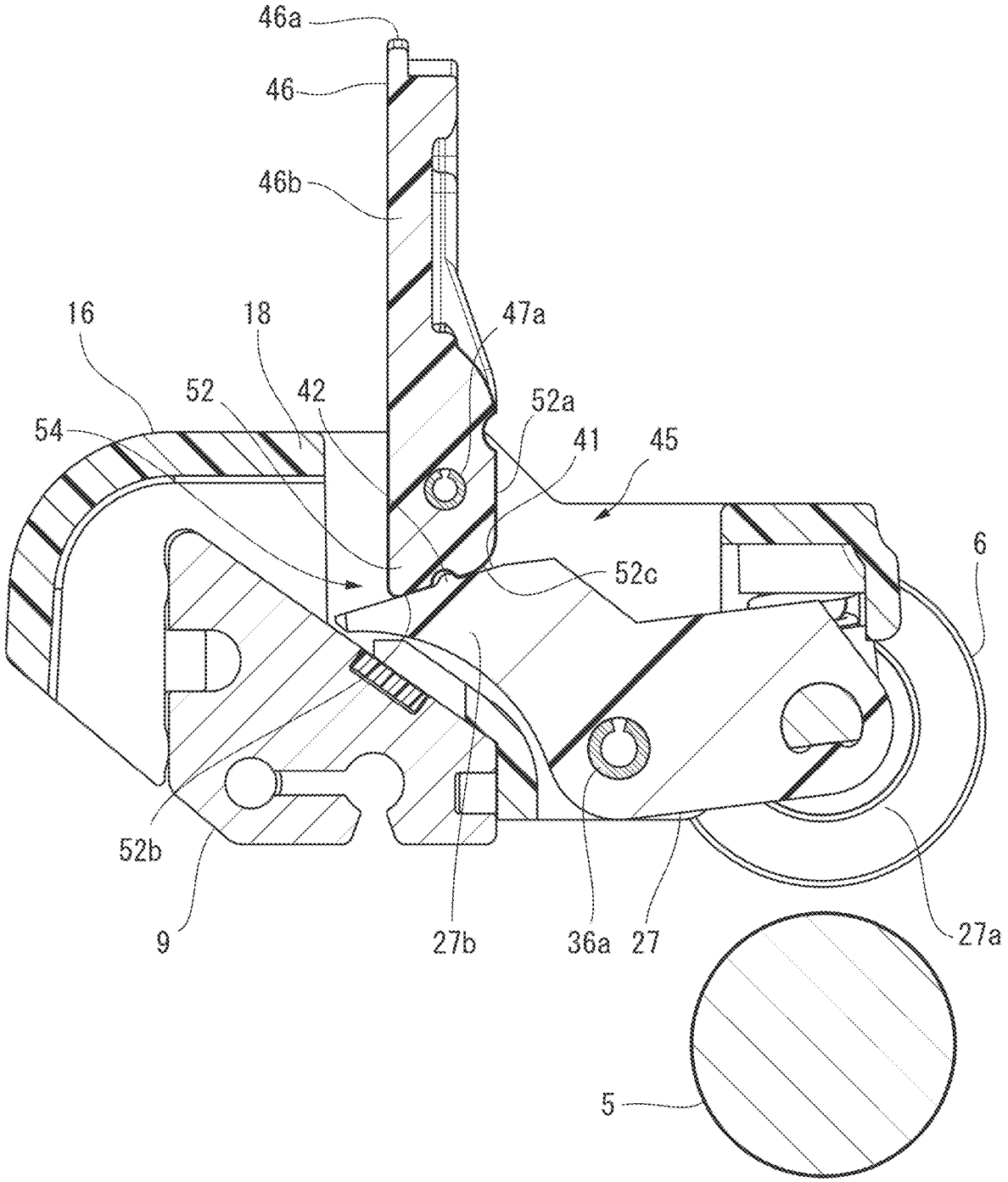
FIG. 16 shows a cross-sectional view of the pinch roller unit when the operating lever is positioned in the operating position.

The upper support pins 47*a* and 47*b* pass through the pivoted ends of the lever portions 46*b* and 46*c*, extending in the left-right direction, and are fixed thereto. Both ends of the upper support pins 47*a* and 47*b* are pivotably fitted to the through holes 48 formed on the right arm 18 and the left arm 19 of the sliding member 16. The operating lever 46 according to this embodiment can swing about the upper support pins 47*a* and 47*b*. The operating lever 46 can take a retracted configuration in which the gripping portion 46*a* is moved rearwards and overlaps the upper end of the sliding member 16 as shown in FIGS. 5 and 14, and a lifted configuration in which the gripping portion 46*a* is lifted upwardly spaced apart from the sliding member 16 as shown in FIG. 16. When the operating lever 46 takes the retracted configuration, the gripping portion 46*a* overlaps the rear connecting portion 21 of the sliding member 16. In the following, the position of the operating lever 46 taking the retracted configuration is referred to as the "retracted position", and the position of the operating lever 46 taking the lifted configuration is referred to as the "operating position".

As shown in FIG. 15C, pressing portions 51 are provided at the pivoted ends of the lever portions 46*b* and 46*c*. The pressing portions 51 are for pressing the front end 27*b* of the right roller support member 27 and the front end 28*b* of the left roller support member 28 downward. The pressing portion 51 according to this embodiment is constituted by a pair of left and right pressing pieces 52 that extend below and forward of the upper support pins 47*a* and 47*b* (through holes 48) when the operating lever 46 is in the retracted configuration. Each pressing piece 52 includes a lower surface 52*a* substantially parallel to the upper surface of the operating lever 46 in the retracted configuration, and a pressing surface 52*b* extending forward and upward from the front end of the lower surface 52*a*. Recesses 53 are formed on the intermediate portions of the pressing surfaces 52*b*. Curved surfaces 52*c* having a predetermined curvature are formed on portions between the lower surfaces 52*a* and the pressing surfaces 52*b*.

The pressing portions 51 face the pressure receiving surfaces 41 formed on the front ends 27*b* and 28*b* of the roller support members 27 and 28. As shown in FIG. 14, when the operating lever 46 is positioned in the retracted position, the lower surfaces 52*a* of the pressing pieces 52 constituting the pressing portions 51 face the pressure receiving surfaces 41. As shown in FIG. 16, when the operating lever 46 is lifted to be in the operating position, the pressing surfaces 52*b* of the pressing pieces 52 face the pressure receiving surfaces 41.

As shown in FIG. 14, when the rear ends 27*a* and 28*a* of the roller support members 27 and 28 are pressed downwards by the spring members 39 and 40, the distance between the pressure receiving surface 41/the protrusion 42 of the front ends 27*b* and 28*b* and the upper support pins 47*a* and 47*b* is greater than the distance between the upper support pins 47*a* and 47*b* and the lower surfaces 52*a* of the pressing pieces 52 but is smaller than the distance between the upper support pins 47*a* and 47*b* and the pressing surfaces 52*b* of the pressing pieces 52. Therefore, when the operating lever 46 is in the retracted position shown in FIG. 14, the lower surfaces 52*a* of the pressing pieces 52 are spaced apart from the pressure receiving surfaces 41 and the protrusions 42 formed on the front ends 27*b* and 28*b* of the roller support members 27 and 28.

In the process of bringing the operating lever 46 up from the retracted position shown in FIG. 14 toward the operating position shown in FIG. 16, the curved surfaces 52*c* between the lower surfaces 52*a* and the pressing surfaces 52*b* contact the pressure receiving surfaces 41 and the protrusions 42 formed on the front ends 27*b* and 28*b* of the right roller support member 27 and the left roller support member 28 from above. The front ends 27*b* and 28*b* of the right roller support member 27 and the left roller support member 28 are pushed downwardly by the pressing pieces 52 as the operating lever 46 further swings in the lifting direction while the curved surfaces 52*c* are in contact with the pressure receiving surfaces 41 and the protrusions 42. At this time, the rear ends 27*a* and 28*a* of the right roller support member 27 and the left roller support member 28 move upwardly against the spring force of the spring members 39 and 40, and the pinch roller 6 moves apart upwards from the medium driving roller 5.

That is, the pressing force release mechanism 45 pushes the rear ends 27*a* and 28*a* of the right roller support member 27 and the left roller support member 28 upwards against the spring forces of the spring members 39 and 40 by means of the operating force applied to the operating lever 46.

The distance between the curved surface 52*c* and the upper support pins 47*a* and 47*b* is shorter than the distance between the upper support pins 47*a* and 47*b* and the gripping portion 46*a*. Therefore, by gripping and pulling up the gripping portion 46*a* so that the pressing pieces 52 press the right roller support member 27 and the left roller support member 28, the gripping portion 46*a* can be operated lightly using the principle of leverage.

The pressing surface 52*b* of the operating lever 46 is formed so as to overlap the pressure receiving surface 41 when the operating lever 46 reaches the operating position in the lifted configuration, as shown in FIG. 16. Moreover, the recess 53 on the pressure receiving surface 41 is formed on a position where the protrusion 42 is inserted when the pressing surface 52*b* overlaps the pressure receiving surface 41. When the configuration is in a position where the pressing surface 52*b* overlaps the pressure receiving surface 41 so that the protrusion 42 is inserted into the recess 53, the operating lever 46 substantially serves as a tension rod, and the right roller support member 27 and the left roller support member 28 are held in said position (the position where the pinch roller 6 is spaced apart from the medium driving roller 5) against the spring forces of the spring members 39 and 40.

That is, the pivoted ends, including the pressing portions 51, of the operating lever 46 and the front ends 27*b* and 28*b* of the right roller support member 27 and the left roller support member 28 have a holding structure 54 that keeps the operating lever 46 in the operating position in which the operating lever 46 takes the lifted configuration. The holding structure 54 is constituted by the protrusions 42 of the roller support members 27 and 28 and recesses 53 of the operating lever 46. By keeping the operating lever 46 in the operating position in this way, the sliding member 16 can be held with one hand and moved along the rail 9 in the left-right direction.

Figure 17:
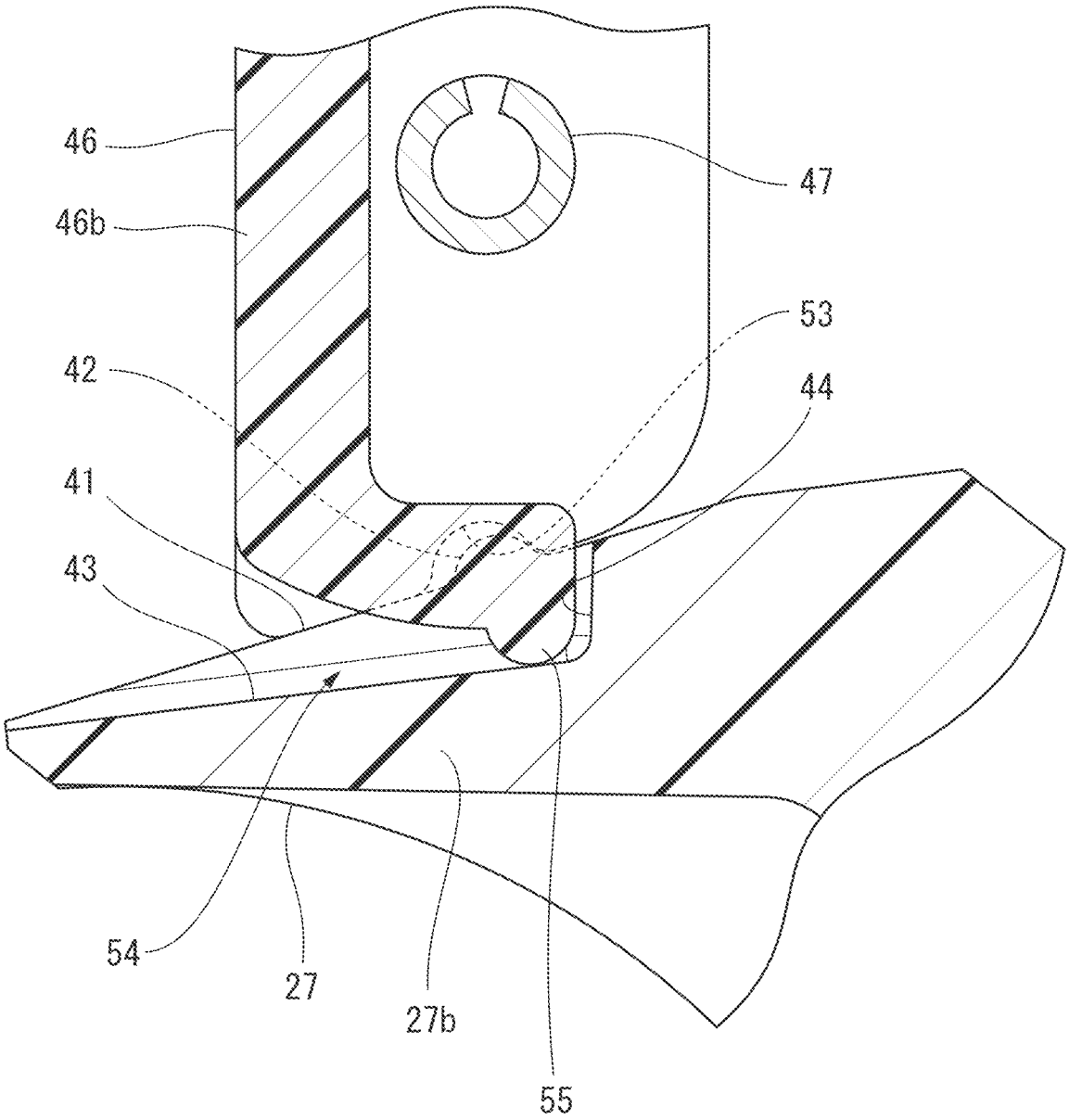
FIG. 17 shows an enlarged cross-sectional view illustrating a portion of the pressing release mechanism.

As shown in FIG. 15C, a stopper piece 55 is provided between the pair of pressing pieces 52 constituting the pressing portion 51. The stopper pieces 55 are intended to restrict the operating lever 46 from swinging furthermore when the operating lever 46 has been swung to the operating position. The stopper pieces 55 are formed to face the vertical walls 44 formed on the front ends 27*b* and 28*b* of the right roller support member 27 and the left roller support member 28 as shown in FIG. 17 when the operating lever 46 is positioned in the operating position. Therefore, when the operating lever 46 swings beyond the operating position, the stopper pieces 55 abut the vertical walls 44 so as to restrict the operating lever 46 from swinging furthermore.

Unlike the first pinch roller unit 7, the second pinch roller unit 8 is not provided with an operating lever 46. Other structures of the second pinch roller unit 8 are substantially equivalent to those of the first pinch roller unit 7. The second pinch roller unit 8 is provided with a cover 56 instead of an operating lever 46, as shown in FIG. 5. The cover 56 is fixed onto the upper end of the sliding member 17.

Operation and Advantageous Effects

When using the cutting plotter 1 equipped with the pinch roller mechanism 11 configured in this way, the pinch roller 6 is first arranged at a position that conforms to the width dimension of the medium 2 to be used. In this case, the gripping portion 46*a* of the operating lever 46 of the first pinch roller unit 7 is held to make the operating lever 46 lifted to be in the operating position. By positioning the operating lever 46 in the operating position, the pinch roller 6 is moved upwardly spaced apart from the medium driving roller 5 by the pressing release mechanism 45, and the operating lever 46 is held in the lifted configuration by the holding structure 54. Therefore, it is possible to move the first pinch roller unit 7 along the rail 9 when the hand is released from the operating lever 46.

Then, the first pinch roller unit 7 is moved so as to align the marker 20*a* of the first pinch roller unit 7 with the target marker 23 of the work stage 3. The sliding member 16 of the first pinch roller unit 7 includes a window portion 22 that exposes the pinch roller 6 to a direction diagonally above the front side (the upstream in the conveyance direction). Therefore, said operation can be performed while looking at the pinch roller 6 through the window portion 22.

When the first pinch roller unit 7 moves to the desired position, the protrusion 25 of the sliding member 16 fits into the recess 13 formed on the plate-shaped member 12 of the rail 9, increasing the resistance when moving the first pinch roller unit 7. The recess 13 is formed so that the protrusion 25 fits into the recess 13 when the pinch roller 6 is positioned at a pinch roller position predetermined for each size of the medium 2. Therefore, it is possible to inform the operator that the pinch roller position for the corresponding size of the medium 2 has been reached.

At this time, the operator determines whether the pinch roller 6 has reached the desired position by looking the pinch roller 6 from the window portion 22. If the position of the pinch roller 6 is not in the vicinity of an end of the medium 2, the first pinch roller unit 7 is further advanced. Meanwhile, when the pinch roller 6 is in the desired position, the operator positions the operating lever 46 to the retracted position by bringing the operating lever 46 down rearwards. When the operating lever 46 is positioned in the retracted position, the pressing portion 51 is moved upwards from the right roller support member 27 and the left roller support member 28 to bring the rear ends 27*a* and 28*a* of the right roller support member 27 and the left roller support member 28 lower by the spring force of the spring members 39 and 40 so that the pinch roller 6 is pressed onto the medium driving roller 5.

Since the rail 9 is formed by a drawn material that is more rigid than a pipe or the like, the pressing force is not reduced even if the pinch roller 6 is located, for example, in the center part of the work stage 3 in the left-right direction.

Thereafter, the medium driving roller 5 is driven to make the medium 2 sandwiched between the medium driving roller 5 and the pinch roller 6 to position the medium 2 at a predetermined cutting start position. It is possible to cut the medium 2 with the cutting plotter 1 in this condition.

Thus, according to the pinch roller mechanism 11 of this embodiment, since the window portion 22 is formed on the sliding member 16 through which the rail 9 passes, the pinch roller 6 can be seen from the window portion 22 without being obstructed by the rail 9. Therefore, even if a highly rigid rail is used as the rail 9, it is possible to provide a plotter pinch roller mechanism 11 that improves the visibility of the pinch roller 6.

In the pinch roller mechanism 11 according to this embodiment, a plurality of functions of a mechanism supporting the pinch roller 6, a pressing release mechanism 45, etc., can be aggregated to be installed in the vicinity of the rail 9. Therefore, since the pinch roller mechanism 11 is compact and inexpensive, it can be integrated on a small plotter for consumer use.

The operating lever 46 according to this embodiment includes a pressing portion 51 that presses the front ends 27*b* and 28*b* of the right roller support member 27 and the left roller support member 28 downward. Therefore, since the right roller support member 27 and the left roller support member 28 can be directly pressed with the operating lever 46 to release the pressing of the pinch roller 6, other members such as a cam member are not necessary to release the pressing of the pinch roller 6. Thus, the number of components is reduced, making it possible to achieve further miniaturization and cost reduction.

The operating lever 46 according to this embodiment is formed in a U shape, and by holding and pulling up the gripping portion 46*a* located on the center part in the left-right direction by hand, the right roller support member 27 and the left roller support member 28 can be pushed by the pressing portion 51 positioned opposite to the gripping portion 46*a*. Therefore, despite pressing the right roller support member 27 and the left roller support member 28 against the spring force of the spring members 39 and 40, it is possible to operate lightly using the principle of leverage.

The pinch roller mechanism 11 according to this embodiment is provided with a holding structure 54 that holds the operating lever 46 in the operating position. Therefore, when the pinch roller 6 is moved, the hand can be removed from the operating lever 46, allowing to operate easily.

The operating lever 46 according to this embodiment is positioned on the rear side (downstream in the conveyance direction) of the pivoted ends of the lever portions 46*b* and 46*c* when positioned in the retracted position. For this reason, the operating lever 46 can be lifted by reaching the hand from the front side of the cutting plotter 1 to the operating lever 46, holding the gripping portion 46*a*, and the gripping portion 46*a* to the near side, allowing to operate easily.

Second Embodiment

Figure 18:
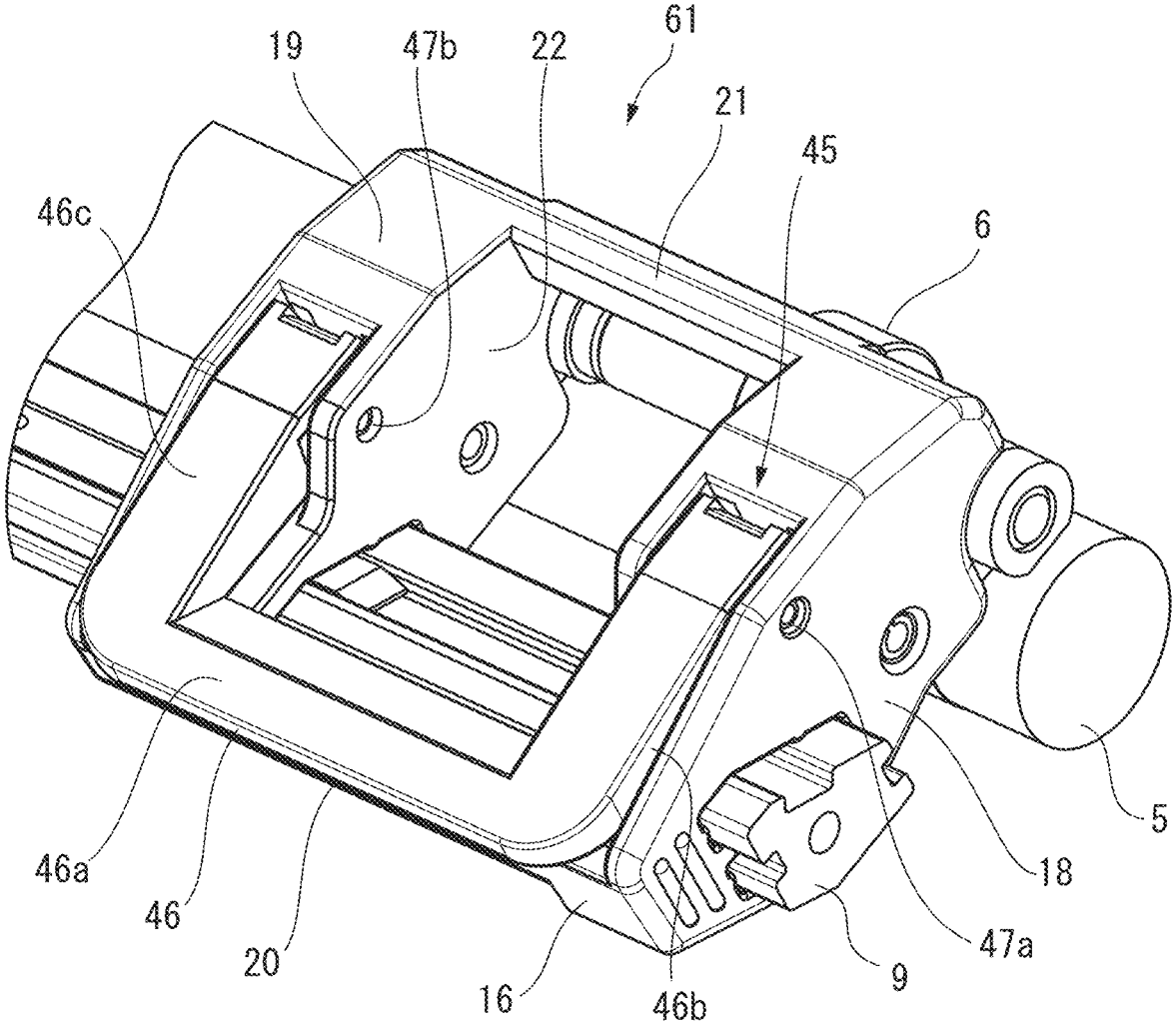
FIG. 18 shows a perspective view of the pinch roller unit according to the second embodiment.

The pinch roller unit can be configured as shown in FIGS. 18-23. The pinch roller unit 61 shown in FIG. 18 is designed to be miniaturized while adopting a substantially equivalent structure as the pinch roller unit 7 in the first embodiment shown in FIGS. 1-17. For this reason, in this embodiment, the same reference signs are assigned to components having the same function as those of the pinch roller unit 7 even if the shapes are different. The detailed description of those components will only be provided as necessary.

Figure 19:
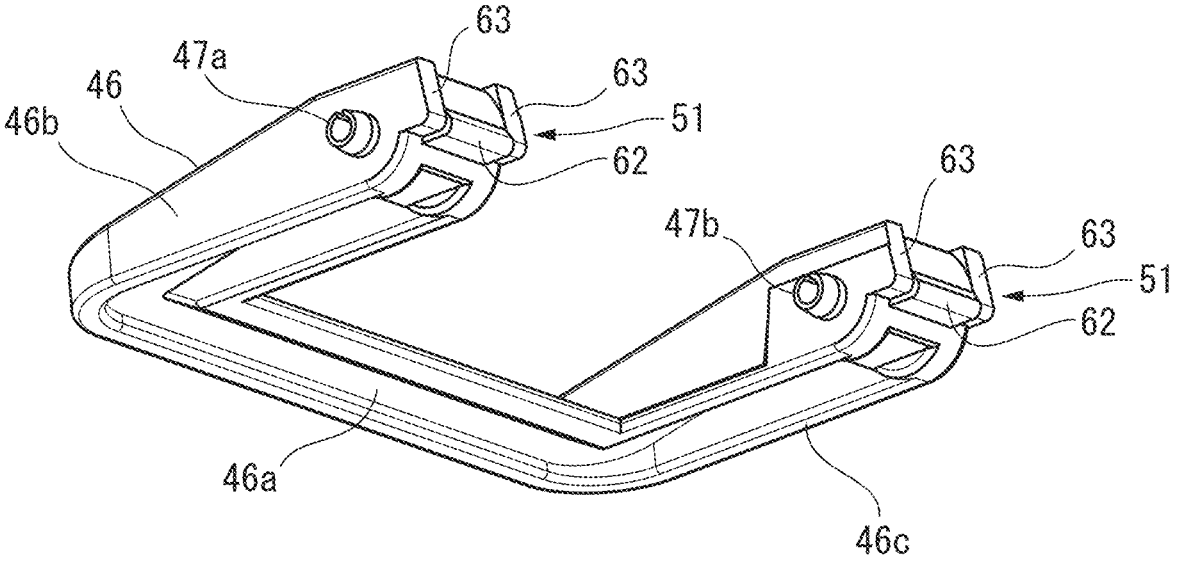
FIG. 19 shows a perspective view of the operating lever.

The pinch roller unit 61 according to this embodiment is different from the pinch roller unit 7 according to the first embodiment in the direction of operating the operating lever 46 of the pressing release mechanism 45. The operating lever 46 shown in FIG. 18 is formed such that the gripping portion 46*a* overlaps the front connecting portion 20 of the sliding member 16 from above in the retracted configuration. As shown in FIG. 19, the pressing portion 51 of the operating lever 46 includes a protrusion 62 and a pair of flat surfaces 63 connected to the left and right sides of the protrusion 62.

Figure 20:
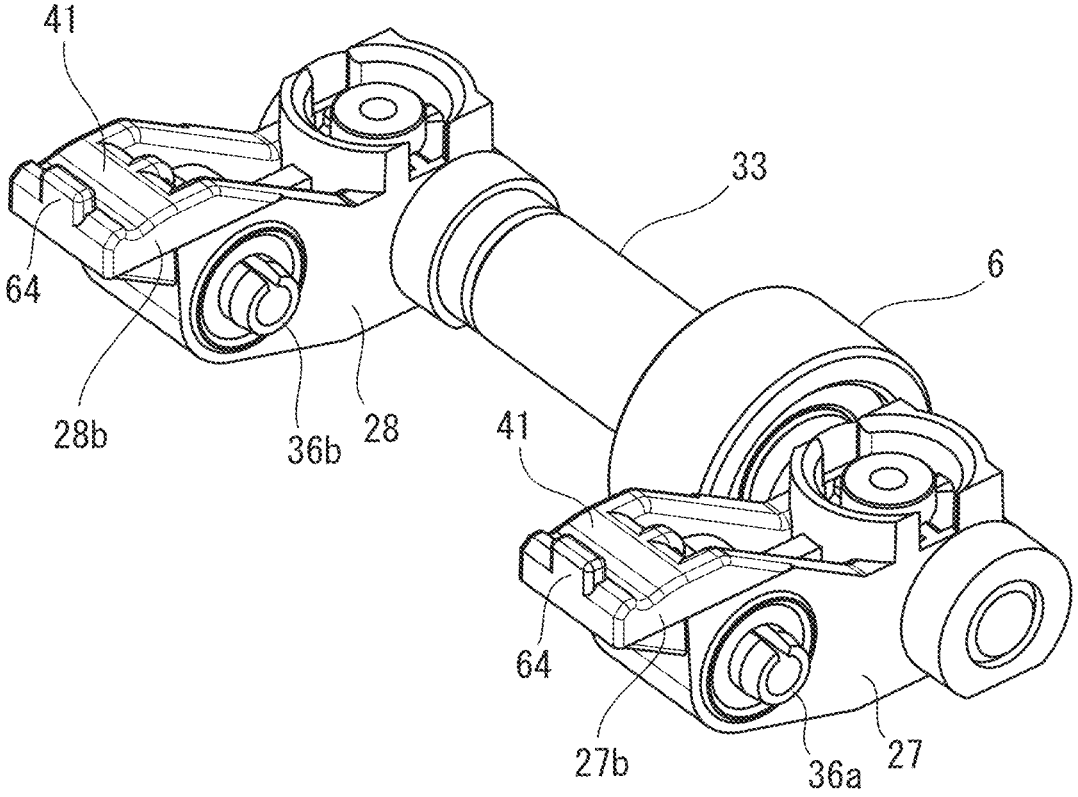
FIG. 20 shows a perspective view of the roller support member.

Meanwhile, the front ends 27*b* and 28*b* of the right roller support member 27 and the left roller support member 28 according to this embodiment include pressure receiving surfaces 41 facing upwards, and stopper pieces 64 protruding upwards from the front ends of the pressure receiving surfaces 41, as shown in FIG. 20. The rear ends 27*a* and 28*a* of the right roller support member 27 and the left roller support member 28 have a structure substantially equivalent to the structure in the first embodiment.

Figure 21:
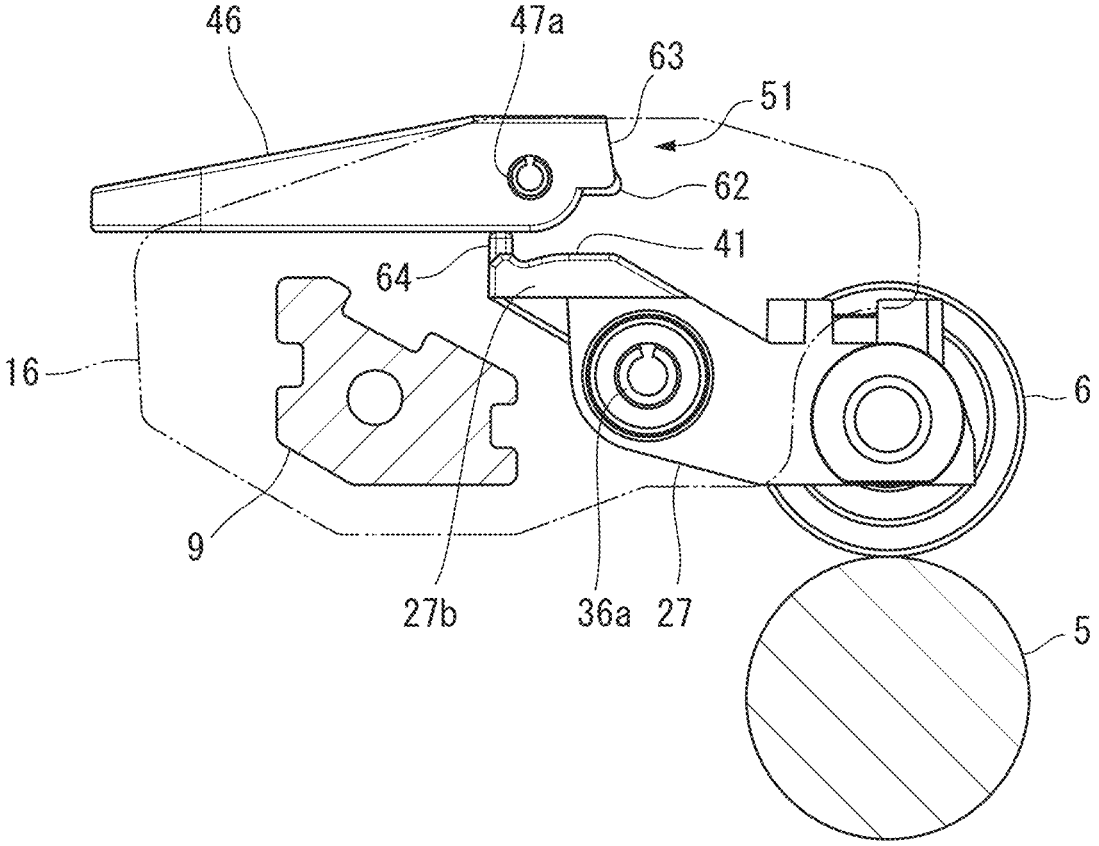
FIG. 21 shows a side view of a substantial part when the operating lever is positioned in the retracted position.
Figure 22:
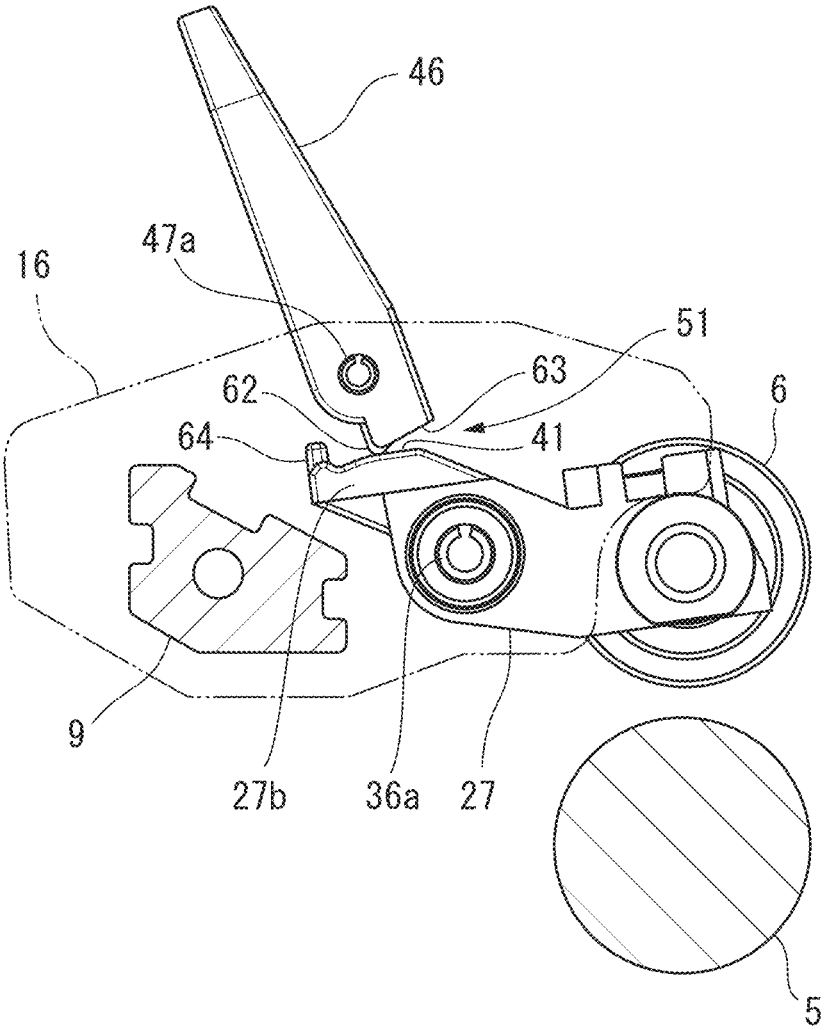
FIG. 22 shows a side view of a substantial part when the roller support member is pressed by the operating lever.

When the operating lever 46 according to this embodiment is positioned in the retracted position, the pressing portions 51 are positioned above the front ends 27*b* and 28*b* of the right roller support member 27 and the left roller support member 28 as shown in FIG. 21. When the gripping portion 46*a* of the operating lever 46 is lifted, the operating lever 46 is lifted from the retracted position so that the protrusions 62 on the pressing portions 51 push the pressure receiving surfaces 41 downward as shown in FIG. 22. As the protrusions 62 press the pressure receiving surfaces 41, the pinch roller 6 moves apart upward from the medium driving roller 5.

Figure 23:
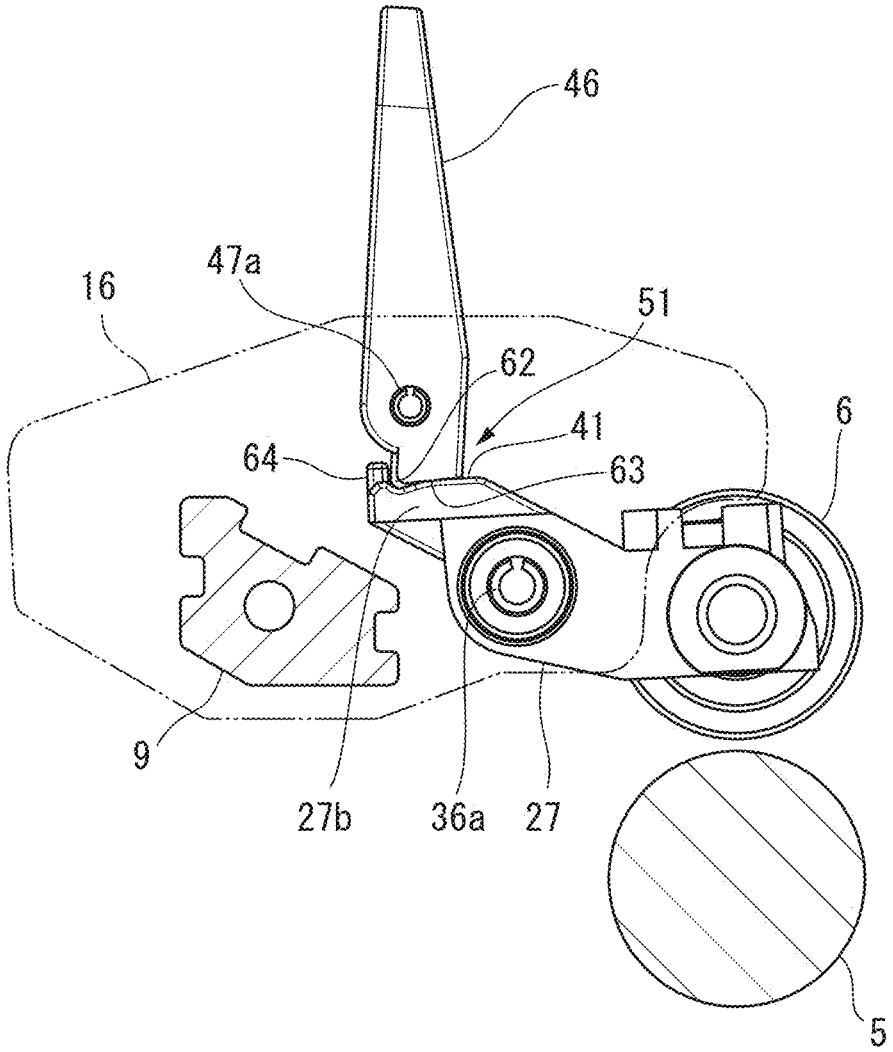
FIG. 23 shows a side view of a substantial part when the operating lever is positioned in the operating position.

Then, when the operating lever 46 is lifted furthermore, the flat surfaces 63 of the pressing portions 51 overlap the pressure receiving surfaces 41 as shown in FIG. 23. In this situation, the pinch roller 6 is lowered downward so that a gap through which the medium 2 can pass is formed between the medium driving roller 5 and the pinch roller 6. In this embodiment, when the operating lever 46 is lifted in this manner, the operating lever 46 is in the operating position. When the operating lever 46 is positioned in the operating position, the operating lever 46 is held in the operating position by a holding structure 54 constituted by the flat surfaces 63 and the pressure receiving surfaces 41. When the operating lever 46 is moved beyond this operating position, the protrusion 62 abuts on the stopper piece 64, allowing to restrict further swinging.

In the retracted position, the gripping portion 46*a* of the operating lever 46 according to this embodiment is positioned on the front side (upstream in the conveyance direction) of the pivoted ends of the lever portions 46*b* and 46*c*. Taking this configuration allows the sliding member 16 to be compact in the front-rear direction while ensuring that the lever portions 46*b* and 46*c* of the operating lever 46 have necessary and sufficient length.

It should be noted that the length of the lever portions 46*b* and 46*c* of the operating lever 46 should not be too short for good operability. Therefore, in the case where the sliding member 16 is formed short in the front-rear direction for compactness, the gripping portion 46*a* may disadvantageously protrude rearward from the sliding member 16 when the operating lever 46 is installed such that the gripping portion 46*a* is positioned rearward in the retracted configuration as in the first embodiment.

There is a movement path on the rear side of the sliding member 16 for the pen carriage 4 to move in the left-right direction. When the gripping portion 46*a* protrudes rearward from the sliding member 16, the distance between the pinch roller unit and the movement path may not be sufficient. Therefore, by installing the operating lever 46 so that the gripping portion 46*a* of the operating lever 46 positioned in the retracted position is positioned on the front side, the sliding member 16 can be made small while ensuring that the distance from the movement path of the pen carriage 4 is sufficiently large.

Examples of the cutting plotter 1 being applied to the present invention have been described in the first and second embodiments described above. However, the present invention can also be applied to a pen plotter that draws characters or pictures on a sheet-shaped medium 2.

APPENDIX

Appendix 1. A plotter pinch roller mechanism comprising: a rail extending above a work stage, to which a sheet-shaped medium is conveyed, in a first direction which intersects with a conveyance direction of the medium and which is parallel to a horizontal direction; a slider supported by the rail and movable in the first direction while the rail is passing through the slider; a roller support member configured to move in an up-down direction while being supported by the slider; a pinch roller which is supported by the roller support member rotatably about an axis in the first direction; a spring which is arranged between the slider and the roller support member and which is configured to bias the roller support member downward; and a pressing release mechanism which includes an operating lever swingably supported by the slider and which is configured to push the roller support member upwards against a spring force of the spring by an operating force applied to the operating lever, wherein the slider includes a window that exposes the pinch roller diagonally upward on the upstream side in the conveyance direction.

The rail may be disposed in an upper vicinity of the work stage.

Appendix 2. The plotter pinch roller mechanism according to Appendix 1, wherein the roller support member is formed to extend in the conveyance direction, includes a first end and a second end opposite each other in the conveyance direction, and is supported by the slider swingably in the up-down direction in an intermediate part in the conveyance direction, the pinch roller is supported by the first end of the roller support member, the spring is configured to bias the first end of the roller support member downward, and the operating lever includes a pressing portion configured to press the second end of the roller support member downward.

Appendix 3. The plotter pinch roller mechanism according to Appendix 2, wherein the first end of the roller support member is positioned downstream of the second end in the conveyance direction, the operating lever includes a gripping portion extending in the first direction, and a pair of lever portions extending from both ends of the gripping portion in a second direction substantially orthogonal to the first direction, the operating lever is swingable between a retracted position and an operating position, the retracted position is a position in which the operating lever overlaps an upper end of the slider while the pair of lever portions is positioned on two sides of the window, the operating position is a position in which the operating lever is lifted about a pivoted end of the pair of lever portions such that the gripping part is spaced apart from the slider, and the pressing portion is provided on the pivoted end of the pair of lever portions and is configured to press the second end of the roller support member downwards while the operating lever is lifted to be in the operating position.

Appendix 4. The plotter pinch roller mechanism according to Appendix 3, further comprising a support pin configured to swingably support the pivoted end of the pair of lever portions, wherein the second end of the roller support member includes a pressure receiving surface that faces the pressing portion formed on the pivoted end of the pair of lever portions, the pressing portion includes a lower surface that faces the pressure receiving surface when the operating lever is positioned in the retracted position, and a pressing surface that faces the pressure receiving surface when the operating lever is lifted to be in the operating position, and a distance between the pressure receiving surface and the supporting pin when the first end of the roller support member is pressed downward by the spring is greater than a distance between the supporting pin and the lower surface of the pressing portion and is less than a distance between the supporting pin and the pressing surface of the pressing portion.

The pressing portion may further include a curved surface between the lower surface and the pressing surface. The distance between the support pin and the curved surface may be shorter than the distance between the support pin and the gripping portion.

Appendix 5. The plotter pinch roller mechanism according to Appendix 3 or 4, wherein the pivoted end of the pair of lever portions and the second end of the roller support member include a holding structure configured to hold the operating lever in the operating position.

Appendix 6. The plotter pinch roller mechanism according to Appendix 5, wherein the holding structure includes: a protrusion formed on the second end of the roller support member; and a first recess which is formed on the pressing portion and into which the protrusion is inserted when the operating lever is lifted to be in the operating position.

Appendix 7. The plotter pinch roller mechanism according to any one of Appendices 3 to 6, further comprising stopper pieces provided on the pivoted end of the pair of lever portions, the second end of the roller support member includes a second recess for the stopper piece to be inserted, the second recess is defined in part by a vertical wall configured to abut the stopper piece when the operating lever is swung beyond the operating position.

The pressing portion may include a pair of pressing pieces disposed on two ends, in the first direction, of each of the pair of lever portions, and the pair of pressing pieces may include the lower surface and the pressing surface. The stopper piece may be disposed between the pair of pressing pieces.

Appendix 8. The plotter pinch roller mechanism according to any one of Appendices 3 to 7, wherein the gripping portion of the operating lever is positioned downstream of the pivoted end of the pair of lever portions in the conveyance direction when the operating lever is positioned in the retracted position.

Appendix 9. The plotter pinch roller mechanism according to any one of Appendices 3 to 7, wherein the gripping portion of the operating lever is positioned upstream of the pivoted end of the pair of lever portions in the conveyance direction when the operating lever is positioned in the retracted position.

Appendix 10. A plotter comprising: a work stage to which a sheet-shaped medium is conveyed; a pen carriage configured to support a pen; the pinch roller mechanism according to any one of Appendices 1-9; and a drive roller configured to rotate while sandwiching the medium between the drive roller and the pinch roller of the pinch roller mechanism.

INCORPORATION BY REFERENCE

This application claims the benefit of foreign priority to Japanese Patent Application No. JP 2023-131965, filed Aug. 14, 2023, which is incorporated by reference in its entirety.

The invention claimed is:

1. A plotter pinch roller mechanism comprising:

a rail extending above a work stage, to which a sheet-shaped medium is conveyed, in a first direction which intersects with a conveyance direction of the medium and which is parallel to a horizontal direction;

a slider supported by the rail and movable in the first direction while the rail is passing through the slider;

a roller support member configured to move in an up-down direction while being supported by the slider;

a pinch roller which is supported by the roller support member rotatably about an axis in the first direction;

a spring which is arranged between the slider and the roller support member and which is configured to bias the roller support member downward; and a pressing release mechanism which includes an operating lever swingably supported by the slider and which is configured to push the roller support member upwards against a spring force of the spring by an operating force applied to the operating lever, wherein the slider includes a window that exposes the pinch roller diagonally upward on the upstream side in the conveyance direction, wherein the roller support member is formed to extend in the conveyance direction, includes a first end and a second end opposite each other in the conveyance direction, and is supported by the slider swingably in the up-down direction in an intermediate part in the conveyance direction, the pinch roller is supported by the first end of the roller support member, the spring is configured to bias the first end of the roller support member downward, and the operating lever includes a pressing portion configured to press the second end of the roller support member downward, and wherein the first end of the roller support member is positioned downstream of the second end in the conveyance direction, the operating lever includes a gripping portion extending in the first direction, and a pair of lever portions extending from both ends of the gripping portion in a second direction substantially orthogonal to the first direction, the operating lever is swingable between a retracted position and an operating position, the retracted position is a position in which the operating lever overlaps an upper end of the slider while the pair of lever portions is positioned on two sides of the window, the operating position is a position in which the operating lever is lifted about a pivoted end of the pair of lever portions such that the gripping part is spaced apart from the slider, and the pressing portion is provided on the pivoted end of the pair of lever portions and is configured to press the second end of the roller support member downwards while the operating lever is lifted to be in the operating position.

2. The plotter pinch roller mechanism according to claim 1, further comprising a support pin configured to swingably support the pivoted end of the pair of lever portions, wherein the second end of the roller support member includes a pressure receiving surface that faces the pressing portion formed on the pivoted end of the pair of lever portions, the pressing portion includes a lower surface that faces the pressure receiving surface when the operating lever is positioned in the retracted position, and a pressing surface that faces the pressure receiving surface when the operating lever is lifted to be in the operating position, and a distance between the pressure receiving surface and the supporting pin when the first end of the roller support member is pressed downward by the spring is greater than a distance between the supporting pin and the lower surface of the pressing portion and is less than a distance between the supporting pin and the pressing surface of the pressing portion.

3. The plotter pinch roller mechanism according to claim 1, wherein the pivoted end of the pair of lever portions and the second end of the roller support member include a holding structure configured to hold the operating lever in the operating position.

4. The plotter pinch roller mechanism according to claim 3, wherein the holding structure includes:

a protrusion formed on the second end of the roller support member; and a first recess which is formed on the pressing portion and into which the protrusion is inserted when the operating lever is lifted to be in the operating position.

5. The plotter pinch roller mechanism according to claim 1, further comprising stopper pieces provided on the pivoted end of the pair of lever portions, the second end of the roller support member includes a second recess for the stopper piece to be inserted, the second recess is defined in part by a vertical wall configured to abut the stopper piece when the operating lever is swung beyond the operating position.

6. The plotter pinch roller mechanism according to claim 1, wherein the gripping portion of the operating lever is positioned downstream of the pivoted end of the pair of lever portions in the conveyance direction when the operating lever is positioned in the retracted position.

7. The plotter pinch roller mechanism according to claim 1, wherein the gripping portion of the operating lever is positioned upstream of the pivoted end of the pair of lever portions in the conveyance direction when the operating lever is positioned in the retracted position.

* * * * *